US011122853B2

(12) United States Patent
Smith et al.

(10) Patent No.: US 11,122,853 B2
(45) Date of Patent: Sep. 21, 2021

(54) FOOT MOTION CONTROL AND/OR STABILITY SYSTEMS FOR ARTICLES OF FOOTWEAR AND OTHER FOOT-RECEIVING DEVICES

(71) Applicant: NIKE, Inc., Beaverton, OR (US)

(72) Inventors: Mark J. Smith, Portland, OR (US); Adam R. Welliver, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 87 days.

(21) Appl. No.: 16/255,526

(22) Filed: Jan. 23, 2019

(65) Prior Publication Data

US 2019/0231024 A1 Aug. 1, 2019

Related U.S. Application Data

(60) Provisional application No. 62/622,423, filed on Jan. 26, 2018.

(51) Int. Cl.
*A43B 3/06* (2006.01)
*A43B 23/02* (2006.01)
(Continued)

(52) U.S. Cl.
CPC ..... *A43B 3/06* (2013.01); *A43B 1/14* (2013.01); *A43B 5/001* (2013.01); *A43B 7/14* (2013.01);
(Continued)

(58) Field of Classification Search
CPC ..... A43C 1/00; A43C 15/061; A43C 15/06; A43C 15/02; A43C 15/04; A43C 13/06;
(Continued)

(56) References Cited

U.S. PATENT DOCUMENTS 34,809 A * 4/1862 Bennet ..... A43C 15/06 36/7.6
2,189,884 A * 2/1940 Dow ..... A43C 15/06 36/7.6
(Continued)

FOREIGN PATENT DOCUMENTS

CA 2471756 A1 * 1/2006 ..... A43C 15/061
CH 288393 A * 1/1953 ..... A43C 15/06
(Continued)

OTHER PUBLICATIONS

May 6, 2019—(WO) ISR & WO—App. No. PCT/US19/015136.

*Primary Examiner* — Alissa L Hoey
*Assistant Examiner* — Patrick J. Lynch
(74) *Attorney, Agent, or Firm* — Banner & Witcoff, Ltd.

(57) ABSTRACT

Footwear includes structural features that may provide one or more of the following features or functions: (a) help "lock" the wearer to the ground under torsional forces induced in the leg/foot (e.g., by a golf swing or other activities); (b) help provide stable support, e.g., at the medial heel and/or lateral forefoot areas; (c) help support and prevent undesired distortion of the footwear upper, e.g., when torsional forces are applied; and/or (d) help provide a very stable and secure feel and fit by securing across the instep portion of the foot, e.g., in a forward lateral-to-rear medial direction (e.g., between medial heel and lateral forefoot sidewall supports).

18 Claims, 22 Drawing Sheets

(51) Int. Cl.

| | |
|---|---|
| ***A43B 13/14*** | (2006.01) |
| ***A43B 5/00*** | (2006.01) |
| ***A43C 1/00*** | (2006.01) |
| ***A43C 7/00*** | (2006.01) |
| ***A43C 15/02*** | (2006.01) |
| ***A43C 15/16*** | (2006.01) |
| ***A43B 13/16*** | (2006.01) |
| ***A43B 13/22*** | (2006.01) |
| ***A43B 13/12*** | (2006.01) |
| ***A43C 11/14*** | (2006.01) |
| ***A43B 1/14*** | (2006.01) |
| ***A43B 7/14*** | (2006.01) |
| *A43B 7/24* | (2006.01) |
| *A43B 3/00* | (2006.01) |

(52) U.S. Cl.

CPC ..... *A43B 13/14* (2013.01); *A43B 23/0235* (2013.01); *A43B 23/0245* (2013.01); *A43C 1/00* (2013.01); *A43C 7/00* (2013.01); *A43C 11/14* (2013.01); *A43C 15/02* (2013.01); *A43C 15/161* (2013.01); *A43B 3/0057* (2013.01); *A43B 7/144* (2013.01); *A43B 7/1435* (2013.01); *A43B 7/24* (2013.01); *A43B 13/122* (2013.01); *A43B 13/16* (2013.01); *A43B 13/223* (2013.01); *A43C 11/1493* (2013.01); *A43C 15/162* (2013.01)

(58) Field of Classification Search

CPC ..... A43C 13/00; A43C 13/37; A43C 11/14; A43C 15/16; A43C 15/162; A43C 13/04; A43B 3/06; A43B 5/001; A43B 5/02; A43B 5/00; A43B 23/08; A43B 7/24; A43B 13/16; A43B 13/12; A43B 5/18; A43B 5/185

See application file for complete search history.

(56) References Cited

U.S. PATENT DOCUMENTS

| | | | | | |
|---|---|---|---|---|---|
| 2,485,706 | A * | 10/1949 | Cruise | A43C 13/06 | 36/73 |
| 2,746,174 | A * | 5/1956 | Patterson, Jr. | A43B 5/18 | 36/7.7 |
| 3,019,533 | A * | 2/1962 | Smith | A43C 15/06 | 36/7.6 |
| 5,425,185 | A * | 6/1995 | Gansler | A43C 11/00 | 36/50.1 |
| 6,163,984 | A * | 12/2000 | Faber | A63C 13/003 | 36/124 |
| 2002/0017036 | A1 | 2/2002 | Berger et al. | | |
| 2004/0250452 | A1* | 12/2004 | Farys | A43B 7/12 | 36/89 |
| 2009/0249653 | A1* | 10/2009 | Gunthel | A43B 5/001 | 36/127 |
| 2011/0113650 | A1* | 5/2011 | Hurd | A43B 7/20 | 36/107 |
| 2012/0233886 | A1* | 9/2012 | Madore | A43B 5/001 | 36/103 |
| 2013/0067776 | A1* | 3/2013 | Auger | A43B 13/184 | 36/25 R |
| 2013/0283644 | A1* | 10/2013 | Ramirez | A43C 15/02 | 36/127 |
| 2015/0230561 | A1* | 8/2015 | Bunch | A43C 15/04 | 36/59 C |
| 2018/0055149 | A1* | 3/2018 | Choi | A43C 15/063 | |

FOREIGN PATENT DOCUMENTS

| | | | | |
|---|---|---|---|---|
| DE | 10315935 | A1 * | 10/2004 | A43B 5/001 |
| FR | 2831030 | A1 * | 4/2003 | A43B 5/001 |
| WO | WO-0135782 | A1 * | 5/2001 | A43C 11/14 |
| WO | WO-0205673 | A1 * | 1/2002 | A43C 15/061 |
| WO | 2011060469 | A1 | 5/2011 | |

* cited by examiner

FOOT MOTION CONTROL AND/OR STABILITY SYSTEMS FOR ARTICLES OF FOOTWEAR AND OTHER FOOT-RECEIVING DEVICES

RELATED APPLICATION DATA

This application claims priority benefits to and is a U.S. Non-Provisional patent application based on U.S. Provisional Patent Appln. No. 62/622,423 filed Jan. 26, 2018. U.S. Provisional Patent Appln. No. 62/622,423 is entirely incorporated herein by reference.

FIELD OF THE INVENTION

The present invention relates to the field of footwear and other foot-receiving devices.

More specifically, aspects of the present invention pertain to foot motion control and/or stability systems for articles of footwear and other foot-receiving devices.

BACKGROUND

Conventional articles of athletic footwear include two primary elements, an upper and a sole structure. The upper provides a covering for the foot that securely receives and positions the foot with respect to the sole structure. In addition, the upper may have a configuration that protects the foot and provides ventilation, thereby cooling the foot and removing perspiration. The sole structure is secured to a lower surface of the upper and is generally positioned between the foot and any contact surface. In addition to attenuating ground reaction forces and absorbing energy, the sole structure may provide traction and control potentially harmful foot motion, such as over pronation. General features and configurations of uppers and sole structures are discussed in greater detail below.

The upper forms a void on the interior of the footwear for receiving the foot. The void has the general shape of the foot, and access to the void is provided at an ankle or foot-insertion opening. Accordingly, the upper extends over the instep and toe areas of the foot, along the medial and lateral sides of the foot, and around the heel area of the foot. A lacing system often is incorporated into the upper to selectively change the size of the ankle opening and to permit the wearer to modify certain dimensions of the upper, particularly girth, to accommodate feet with varying proportions. In addition, the upper may include a tongue that extends under the lacing system to enhance the comfort of the footwear (e.g., to modulate pressure applied to the foot by the laces), and the upper also may include a heel counter to limit or control movement of the heel.

The sole structure generally incorporates multiple layers that are conventionally referred to as an "insole," a "midsole," and an "outsole." The insole (which also may constitute a sock liner) is a thin member located within the upper and adjacent the plantar (lower) surface of the foot to enhance footwear comfort, e.g., to wick away moisture. The midsole, which is traditionally attached to the upper along the upper's entire length, forms the middle layer of the sole structure and serves a variety of purposes that include controlling foot motions and attenuating impact forces. The outsole forms the ground-contacting element of footwear and usually is fashioned from a durable, wear-resistant material that includes texturing or other features to improve traction.

The primary element of a conventional midsole is a resilient, polymer foam material, such as polyurethane or ethylvinylacetate ("EVA"), that extends throughout the length of the footwear. The properties of the polymer foam material in the midsole are primarily dependent upon factors that include the dimensional configuration of the midsole and the specific characteristics of the material selected for the polymer foam, including the density of the polymer foam material. By varying these factors throughout the midsole, the relative stiffness, the degree of ground reaction force attenuation, and the energy absorption properties may be altered to meet the specific demands of the activity for which the footwear is intended to be used.

TERMINOLOGY/GENERAL INFORMATION

First, some general terminology and information is provided that will assist in understanding various portions of this specification and the invention(s) as described herein. As noted above, the present invention relates to the field of footwear and other foot-receiving devices, including securing systems for such devices. "Foot-receiving device" means any device into which a user places at least some portion of his or her foot. In addition to all types of footwear (described below), foot-receiving devices include, but are not limited to: bindings and other devices for securing feet in snow skis, cross country skis, water skis, snowboards, and the like; bindings, clips, or other devices for securing feet in pedals for use with bicycles, exercise equipment, and the like; bindings, clips, or other devices for receiving feet during play of video games or other games; and the like. "Foot-receiving devices" may include one or more "foot-covering members" (e.g., akin to footwear upper components), which help position the foot with respect to other components or structures and one or more "foot-supporting members" (e.g., akin to footwear sole structure components), which support at least some portion(s) of a plantar surface of a user's foot. "Securing systems," like those in accordance with at least some aspects of this invention, may help position and/or securely hold the user's foot in place with respect to the foot-covering member(s) and/or the foot-supporting member(s). "Footwear" means any type of wearing apparel for the feet, and this term includes, but is not limited to: all types of shoes, boots, sneakers, sandals, thongs, flip-flops, mules, scuffs, slippers, sport-specific shoes (such as golf shoes, tennis shoes, baseball cleats, soccer or football cleats, ski boots, basketball shoes, cross training shoes, track shoes, track field event shoes (e.g., for high jump, triple jump, etc.), etc.), and the like. "Foot-supporting members" may include components for and/or functioning as midsoles and/or outsoles for articles of footwear (or components providing corresponding functions in non-footwear type foot-receiving devices).

FIG. 5 also provides information that may be useful for explaining and understanding the specification and/or aspects of this invention. More specifically, FIG. 5 provides a representation of a footwear/foot-receiving device component 100, which in this illustrated example constitutes a portion of a sole structure for an article of footwear. The same general definitions and terminology described below may apply to footwear and foot-receiving devices in general and/or to other footwear/foot-receiving device components or portions thereof, such as an upper, a midsole component, an outsole component, etc.

First, as illustrated in FIG. 5, the terms "forward" or "forward direction" as used herein, unless otherwise noted or clear from the context, mean toward or in a direction toward a forward-most toe area FT of the footwear or foot-receiving device structure or component 100. The terms "rearward" or "rearward direction" as used herein, unless otherwise noted or clear from the context, mean toward or in a direction toward a rear-most heel area RH of the footwear or foot-receiving device structure or component 100. The terms "lateral" or "lateral side" as used herein, unless otherwise noted or clear from the context, mean the outside or "little toe" side of the footwear or foot-receiving device structure or component 100. The terms "medial" or "medial side" as used herein, unless otherwise noted or clear from the context, mean the inside or "big toe" side of the footwear or foot-receiving device structure or component 100.

Also, various example features and aspects of this invention are disclosed or explained herein with reference to a "longitudinal direction" and/or with respect to a "longitudinal length" L of a footwear/foot-receiving device component 100 (such as a footwear sole structure). As shown in FIG. 5, the "longitudinal direction" is determined as the direction of a line extending from a rearmost heel location (RH in FIG. 5) to the forwardmost toe location (FT in FIG. 5) of the footwear component 100 in question (a sole structure or foot-supporting member in this illustrated example). The "longitudinal length" L is the length dimension measured from the rearmost heel location RH to the forwardmost toe location FT. The rearmost heel location RH and the forwardmost toe location FT may be located by determining the rear heel and forward toe tangent points with respect to front and back parallel vertical planes VP when the component 100 (e.g., sole structure or foot-supporting member in this illustrated example, optionally as part of an article of footwear or foot-receiving device) is oriented on a horizontal support surface S in an unloaded condition (e.g., with no weight applied to it other than potentially the weight of the shoe/foot-receiving device components with which it is engaged). If the forwardmost and/or rearmost locations of a specific footwear or foot-receiving device component 100 constitute a line segment (rather than a tangent point), then the forwardmost toe location and/or the rearmost heel location constitute the mid-point of the corresponding line segment. If the forwardmost and/or rearmost locations of a specific footwear or foot-receiving device component 100 constitute two or more separated points or line segments, then the forwardmost toe location and/or the rearmost heel location constitute the mid-point of a line segment connecting the furthest spaced and separated points and/or furthest spaced and separated end points of the line segments (irrespective of whether the midpoint itself lies on the component 100 structure). If the forwardmost and/or rearwardmost locations constitute one or more areas, then the forwardmost toe location and/or the rearwardmost heel location constitute the geographic center of the area or combined areas (irrespective of whether the geographic center itself lies on the component 100 structure).

Once the longitudinal direction of a component or structure 100 has been determined with the component 100 oriented on a horizontal support surface S, planes may be oriented perpendicular to this longitudinal direction (e.g., planes running into and out of the page of FIG. 5). The locations of these perpendicular planes may be specified based on their positions along the longitudinal length L where the perpendicular plane intersects the longitudinal direction between the rearmost heel location RH and the forwardmost toe location FT. In this illustrated example of FIG. 5, the rearmost heel location RH is considered as the origin for measurements (or the "0 L position") and the forwardmost toe location FT is considered the end of the longitudinal length of this component (or the "1.0 L position"). Plane position may be specified based on its location along the longitudinal length L (between 0 L and 1.0 L), measured forward from the rearmost heel RH location in this example. FIG. 5 further shows locations of various planes perpendicular to the longitudinal direction (and oriented in the transverse direction) and located along the longitudinal length L at positions 0.25 L, 0.4 L, 0.5 L, 0.55 L, 0.6 L, and 0.8 L (measured in a forward direction from the rearmost heel location RH). These planes may extend into and out of the page of the paper from the view shown in FIG. 5, and similar planes may be oriented at any other desired positions along the longitudinal length L. While these planes may be parallel to the parallel vertical planes VP used to determine the rearmost heel RH and forwardmost toe FT locations, this is not a requirement. Rather, the orientations of the perpendicular planes along the longitudinal length L will depend on the orientation of the longitudinal direction, which may or may not be parallel to the horizontal surface S in the arrangement/orientation shown in FIG. 5.

The terms "strap" and "strap portion" as used herein, unless otherwise noted, mean a band of material having a substantially greater width dimension ("W") than a thickness dimension ("T"). In some example structures, "straps" or "strap portions" also may have a substantially greater length dimension ("L") than width dimension W. As some more specific examples, "straps" or "strap portions" in accordance with at least some examples of this invention may have one or more of: (a) a width dimension to thickness dimension ratio ("W/T") over at least 75% of its length of at least 5, (b) an absolute width dimension W of at least 10 mm over at least 75% of its length L, (c) an absolute thickness dimension T of less than 3 mm over at least 75% of its length L, and/or (d) an absolute length dimension L of at least 2.5 times its widest width dimension over that length. A "strap" or "strap portion" may be connected to or integrally formed with another element or component that is not a "strap" or "strap portion."

As some more specific examples, "straps" or "strap portions" in accordance with at least some examples of this invention may have one or more of:

a. a W/T ratio over at least 75% of the strap's length of at least 7.5, at least 10, at least 15, at least 20, or at least 25; in some examples, these W/T ratio ranges will be provided over at least 85%, at least 90%, at least 95%, or even over 100% of the strap's length;
b. a W/T ratio over at least 75% of strap's length in a range of 5 to 50, in a range of 7.5 to 48, or in a range of 10 to 45; in some examples, these W/T ratio ranges will be provided over at least 85%, at least 90%, at least 95%, or even over 100% of the strap's length;
c. an absolute thickness dimension T of less than 2.5 mm or less than 2 mm over at least 75% of the strap's length; in some examples, these thickness dimension T ranges will be provided over at least 85%, at least 90%, at least 95%, or even over 100% of the strap's length;
d. an absolute width dimension W over at least 75% of the strap's length of at least 8 mm, at least 10 mm, at least 15 mm, or at least 18 mm; in some examples, these width dimension ranges will be provided over at least 85%, at least 90%, at least 95%, or even over 100% of the strap's length;
e. an absolute width dimension W over at least 75% of the strap's length within a range from 8 to 75 mm, and in some examples, within a range from 10 to 65 mm or within a range from 12 to 60 mm; in some examples, these absolute strap width dimension W ranges will be provided over at least 85%, at least 90%, at least 95%, or even over 100% of the strap's length;

f. an absolute strap length L of at least 3 times or at least 5 times the strap's widest width dimension W over that length;

g. an absolute width dimension W that varies over the strap's length, e.g., tapers, stepwise changes, or otherwise varies in width from wider to narrower or vice versa (e.g., having a width of 40 to 60 mm or larger at locations where engaged with and/or emerging from a sole structure and a width of 15 to 25 mm at its free end); and/or h. an absolute thickness dimension T that varies over its length and/or width, e.g., tapers, stepwise changes, or otherwise varies in thickness from thicker to thinner or vice versa).

For determining the W/T ratios as described above, the width and thickness dimensions are measured at a common location on the strap structure. The strap's length dimension L may be measured as the dimension from: (a) a location where one end of the strap is fixed to the upper or sole structure (e.g., where the strap emerges from a location between the upper and the sole structure) and (b) a free end of the strap. The strap's thickness dimension T at a given point is measured as the direct distance (shortest distance) between a first major surface and a second major surface of the strap at that point. The strap's width dimension W at a given point is measured as the direct distance (shortest distance) from one side edge of the strap to its opposite side edge at that point. These measurements are made with the strap or strap portion held taut but not under a substantial tensile force (e.g., less than 0.5 kg tensile force).

While straps or strap portions may be stretchable or unstretchable, in the illustrated examples, the straps and strap portions are unstretchable. The terms "not stretchable" or "unstretchable," as used herein in this context, mean that the strap or strap portion stretches less than 5% of its unloaded longitudinal length under a tensile force of 10 kg.

As used in this specification, a cleat surface will be considered "substantially flat" if at least 80% of the area of that cleat surface lies within ±2 mm of a central or base plane for that surface. In some examples, a "substantially flat" cleat surface will have at least 80% of its surface change in elevation by less than 2 mm from a mean surface level when the cleat surface is oriented horizontally. The term "substantially flat" as used herein includes surfaces that are perfectly flat (i.e., planar).

As used in this specification, a cleat surface will be considered "substantially vertical" if at least 80% of the area of that cleat surface is located within an angle of 90°±10° from a horizontal base surface when a bottom surface of the footwear component including the cleat surface is supported on the horizontal base surface in an unloaded condition (i.e., with no forces applied to the footwear component other than possibly the weight of other footwear components making up the sole structure and/or article of footwear). The term "substantially vertical" as used herein includes surfaces that are perfectly vertical (i.e., oriented at 90° from a horizontal base surface under the measuring conditions described above).

SUMMARY OF THE INVENTION

Footwear and other foot-receiving devices include structural features that may provide one or more of the following features or functions: (a) help "lock" the wearer to the ground under torsional forces induced in the leg/foot (e.g., by a golf swing or other activities); (b) help provide stable support, e.g., at the medial heel and/or lateral forefoot areas; (c) help support and prevent undesired distortion of the footwear upper, e.g., when torsional forces are applied; and/or (d) help provide a very stable and secure feel and fit by securing across the instep portion of the foot, e.g., in a forward lateral-to-rear heel direction (e.g., between medial heel and lateral forefoot sidewall supports).

BRIEF DESCRIPTION OF THE DRAWINGS

The foregoing Summary, as well as the following Detailed Description, will be better understood when read in conjunction with the accompanying drawings in which like reference numerals refer to the same or similar elements in all of the various views in which that reference number appears.

Figure 1A:
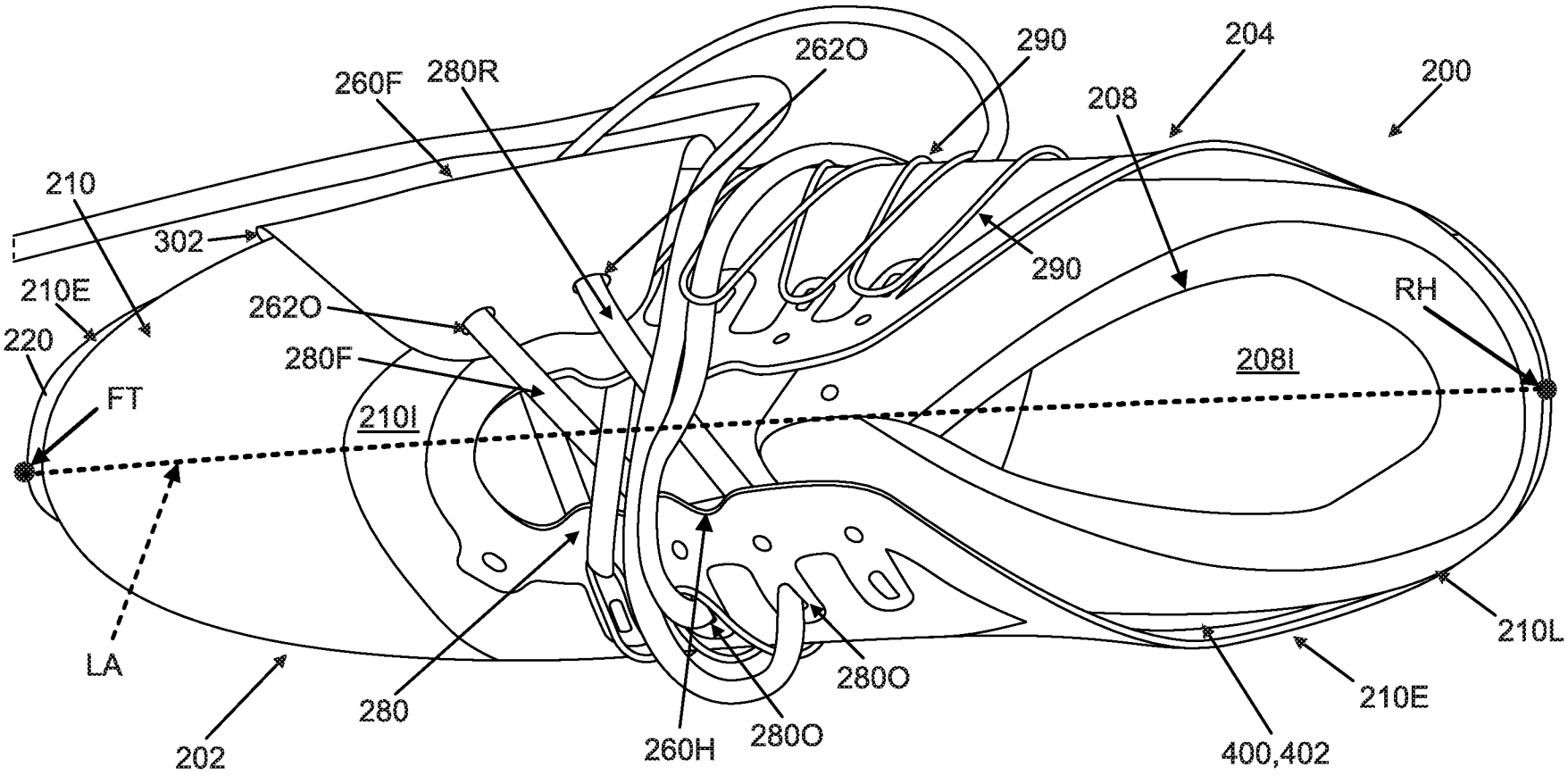
FIGS. 1A through 1I provide various views of an article of footwear and/or components thereof in accordance with an example of this invention.

The reader should understand that the attached drawings are not necessarily drawn to scale.

DETAILED DESCRIPTION

In the following description of various examples of footwear and foot-receiving device structures and components according to the present invention, reference is made to the accompanying drawings, which form a part hereof, and in which are shown by way of illustration various example structures and environments in which aspects of the invention may be practiced. It is to be understood that other structures and environments may be utilized and that structural and functional modifications may be made from the specifically described structures and functions without departing from the scope of the present invention.

I. Detailed Description of Example Articles of Footwear or Other Foot-Receiving Devices According to this Invention Referring to the figures and following discussion, various articles of footwear/foot-receiving devices and features thereof in accordance with aspects of the present invention are disclosed. The footwear depicted and discussed are athletic shoes (e.g., golf shoes), but the concepts disclosed with respect to this footwear may be applied to a wide range of athletic footwear styles, including, but not limited to: walking shoes, tennis shoes, soccer shoes, football shoes, basketball shoes, running shoes, track shoes, shoes for track field events (e.g., high jump, triple jump, etc.) and cross-training shoes. In addition, the concepts of the present invention may be applied to a wide range of non-athletic footwear, including work boots, sandals, loafers, and dress shoes, as well as to other foot-receiving devices.

Articles of footwear (or other foot-receiving devices) in accordance with at least some examples and aspects of this invention will have a first side (e.g., a medial side) and a second side (e.g., a lateral side) opposite the first side and may include: (a) an upper (or other foot-covering member) including an instep portion; (b) a sole structure (or other foot-supporting member) engaged with the upper/foot-covering member; (c) a heel support engaged with at least one of the upper/foot-covering member or the sole structure/foot-supporting member, wherein the heel support is located on the first side of the article of footwear/foot-receiving device and includes: (i) a bottom heel support portion forming a first side heel plantar support surface at the first side of the article of footwear/foot-receiving device, and (ii) a sidewall portion extending upward from the bottom heel support portion, wherein the sidewall portion of the heel support includes a forward edge located in a heel area or a midfoot area of the article of footwear/foot-receiving device; (d) a forefoot support engaged with at least one of the upper/foot-covering member or the sole structure/foot-supporting member, wherein the forefoot support is located on the second side of the article of footwear/foot-receiving device opposite from the first side of the article of footwear/foot-receiving device and includes: (i) a bottom forefoot support portion forming a second side forefoot plantar support surface at the second side of the article of footwear/foot-receiving device, and (ii) a sidewall portion extending upward from the bottom forefoot support portion, wherein the sidewall portion of the forefoot support includes a rearward edge located in a forefoot area or the midfoot area of the article of footwear/foot-receiving device; and (e) a strap system connecting the heel support and the forefoot support across the instep portion.

Articles of footwear (or other foot-receiving devices) in accordance with some examples and aspects of this invention will have a first side (e.g., a medial side) and a second side (e.g., a lateral side) opposite the first side and may include: (a) an upper (or other foot-covering member); (b) a sole structure (or other foot-supporting member) engaged with the upper/foot-covering member that includes: (i) a first plurality of cleats located in a heel area of the sole structure/foot-supporting member and closer to the first side of the article of footwear/foot-receiving device than to the second side (e.g., along and/or near the first side edge), wherein two or more of the first plurality of cleats include a substantially flat and substantially vertical wall facing the first side of the article of footwear/foot-receiving device, and (ii) a second plurality of cleats located in a forefoot area of the sole structure/foot-supporting member and closer to the second side of the article of footwear/foot-receiving device than to the first side (e.g., along and/or near the second side edge), wherein two or more of the second plurality of cleats include a substantially flat and substantially vertical wall facing the second side of the article of footwear/foot-receiving device; (c) a heel support sidewall engaged with at least one of the upper/foot-covering member or the sole structure/foot-supporting member, wherein the heel support sidewall extends only along the first side of the article of footwear/foot-receiving device, wherein the heel support sidewall includes a forwardmost edge located in a heel area or a midfoot area of the article of footwear/foot-receiving device, and wherein the heel support sidewall is formed from at least one of a metal material or a molded polymer material; and (d) a forefoot support sidewall engaged with at least one of the upper/foot-covering member or the sole structure/foot-supporting member, wherein the forefoot support sidewall extends only along the second side of the article of footwear/foot-receiving device, wherein the forefoot support sidewall includes a rearwardmost edge located in a forefoot area or the midfoot area of the article of footwear/foot-receiving device, and wherein the forefoot support sidewall is formed from at least one of a metal material or a molded polymer material.

Articles of footwear (or other foot-receiving devices) in accordance with still additional examples and aspects of this invention will include a first side (e.g., a medial side) and a second side (e.g., a lateral side) opposite the first side and may include: (a) an upper (or other foot-covering member); (b) a sole structure (or other foot-supporting member) engaged with the upper/foot-covering member); (c) a heel support sidewall engaged with at least one of the upper/foot-covering member or the sole structure/foot-supporting member, wherein the heel support sidewall extends only along the first side of the article of footwear/foot-receiving device, wherein the heel support sidewall includes a forwardmost edge located in a heel area or a midfoot area of the article of footwear/foot-receiving device, and wherein the heel support sidewall is formed from at least one of a metal material or a molded polymer material; (d) a forefoot support sidewall engaged with at least one of the upper/foot-covering member or the sole structure/foot-supporting member, wherein the forefoot support sidewall extends only along the second side of the article of footwear/foot-receiving device, wherein the forefoot support sidewall includes a rearwardmost edge located in a forefoot area or the midfoot area of the article of footwear/foot-receiving device, and wherein the forefoot support sidewall is formed from at least one of a metal material or a molded polymer material; and (e) a strap system connecting the heel support sidewall and the forefoot support sidewall across an instep portion of the upper.

Additional aspects of this invention relate to more specific features of the various footwear components described above and described in more detail below, including more specific features of: the strap system location and structural features (e.g., including one or more straps, strap engagement with support sidewalls, etc.); the strap securing system location and structural features (e.g., hook-and-loop fasteners, buckle fasteners, snap fasteners, button fasteners, magnetic fasteners, etc.); cleat locations and structural features (e.g., including torsion-inhibiting cleat structures); heel support sidewall locations and structural features; forefoot support sidewall locations and structural features; outsole component locations and structural features (e.g., including features of the bottom heel support portion of the heel support and/or the bottom forefoot support portion of the forefoot support); etc. These additional aspects of the invention may be included as part of any of the individual examples and aspects of the invention described in the paragraphs above.

Still additional aspects of this invention relate to methods of making articles of footwear and/or other foot-receiving devices, e.g., of the types and having the structures described above (and described in more detail below).

Given the above background and general description of aspects and examples of this invention, a more detailed description of specific examples of articles of footwear in accordance with at least some examples of this invention follows.

II. Detailed Description of Specific Example Articles of Footwear According to this Invention FIGS. 1A-1I provide various views of an example article of footwear 200 in accordance with at least some examples of this invention. This example article of footwear 200 includes a first side (e.g., medial side 202) and a second side (e.g., lateral side 204) opposite the first side, and an axis LA extending in the longitudinal direction (as described above, from the rearmost heel location RH to the forwardmost toe location FT) separates the medial side 202 from the lateral side 204. The article of footwear 200 further includes an upper 210 and a sole structure 220 engaged with the upper 210, e.g., in any manner known and used in the art, including via adhesives or cements; via mechanical connectors; etc.

The upper 210 may be made from one or more component parts and/or made from any desired material(s), including one or more component parts and/or material(s) as are conventionally known and used in the footwear arts. When made from multiple component parts, the upper 210 components may be engaged with one another in any desired manner, including in manners as are conventionally known and used in the footwear arts (e.g., via adhesives, cements or other fusing/bonding techniques; via mechanical connectors; via sewn seams; etc.). In some example structures according to aspects of this invention, as will be described in more detail below, the upper 210 may include multiple layers of material that, at least in part, define an opening 208 to an interior chamber 208I of the article of footwear 200 for receiving a wearer's foot. Some specific example upper 210 parts that form part of and/or contribute to aspects of the present invention are described in more detail below.

The sole structure 220 also may be made from one or more component parts and/or made from any desired material(s), including one or more component parts and/or material(s) as are conventionally known and used in the footwear arts. When made from multiple component parts, the sole structure 220 components may be engaged with one another in any desired manner, including in manners as are conventionally known and used in the footwear arts (e.g., via adhesives, cements or other fusing/bonding techniques; via mechanical connectors; via sewn seams; etc.). In some example structures according to aspects of this invention, the sole structure 220 includes a polymer foam midsole 222 (e.g., formed from polyurethane and/or ethylvinylacetate (EVA) foams) and/or other midsole impact force attenuating components, e.g., as are known and used in the footwear arts (such as one or more fluid-filled bladders, one or more mechanical shock absorbing members (such as springs), one or more column type shock absorbing members, etc.). The sole structure 220 also may include one or more outsole components, such as outsole component 224 shown in FIG. 1D. Some specific example sole structure 220 parts that form part of and/or contribute to aspects of the present invention (e.g., bottom portions of a heel support component and/or a forefoot support component) are described in more detail below.

This example article of footwear 200 includes a heel support sidewall 402 engaged with at least one of the upper 210 or the sole structure 220 (e.g., at least with midsole 222 in this illustrated example). The heel support sidewall 402 may be included as part of a heel support 400, e.g., of the type shown in FIGS. 3A-3D, and optionally may include a bottom heel support portion 404 for supporting a portion of the plantar surface of a wearer's foot. In the illustrated example, the heel support 400 includes: (a) the bottom heel support portion 404 forming a first side (e.g., medial side 202) heel plantar support surface at the first side (e.g., medial side 202) of the article of footwear 200 and (b) the heel support sidewall 402 portion extending upward from the bottom heel support portion 404. The sidewall 402 portion of the heel support 400 includes a forward edge 402E located in a heel area or a midfoot area of the article of footwear 200. The overall heel support 400 (including both the heel support sidewall 402 and the bottom heel support portion 404) may be formed as a unitary, one-piece structure, e.g., from any of the materials described below, potentially in a molding process (e.g., injection molding).

Figure 1B:
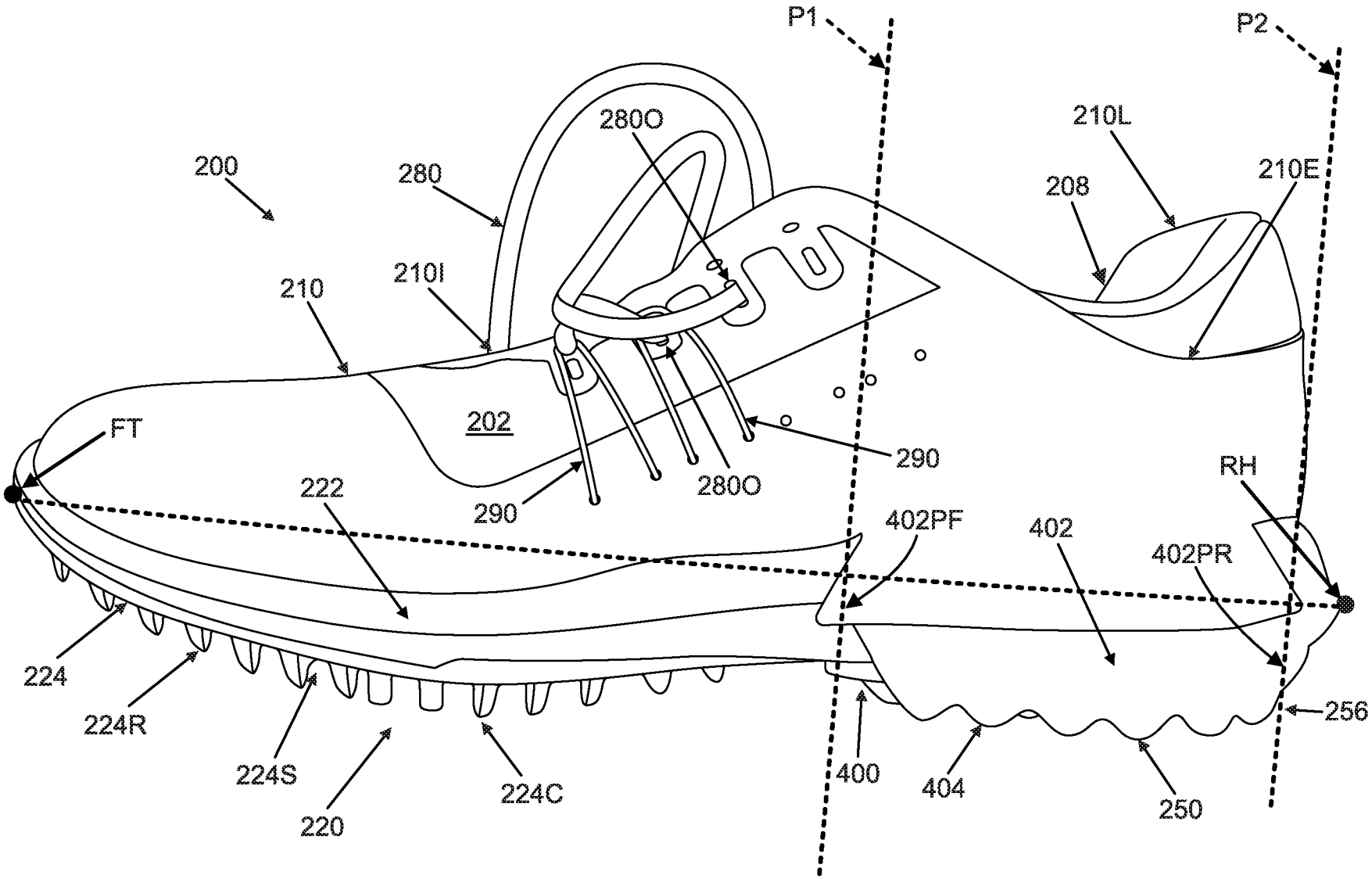

As shown in FIGS. 1A, 1B, 1E, and 1G, in this illustrated example, at least some (and optionally, a majority) of the heel support sidewall 402 is located between an exterior layer 210E and an interior layer 210L of the upper 210. The interior layer 210L of the upper 210 may constitute a "bootie" component or other upper component that defines at least a portion of the interior chamber 208I for receiving a wearer's foot. Alternatively, if desired, the heel support sidewall 402 may be at least partially visible and at least partially exposed (and optionally fully visible and fully exposed) at an exterior of the article of footwear 200 (and outside exterior layer 210E). As shown in FIG. 1B, the heel support sidewall 402 of this example begins at an exterior location of the article of footwear 200 at/near the sole structure 220 and tucks between the exterior layer 210E and interior layer 210L of the upper 210 as it extends upward from the bottom heel support portion 404.

The heel support sidewall 402 (and optionally the overall heel support 400 along with the bottom heel support portion 404) may be formed of a rigid material, such as at least one of a metal material or a molded polymer material (such as a thermoplastic elastomer (e.g., a thermoplastic polyurethane ("TPU")), a thermoset material, a polyether block amide thermoplastic elastomer, a fiber reinforced plastic material, etc.). In at least some examples of this invention, at least the heel support sidewall 402 (and optionally the bottom heel support portion 404 as well) may include portions at least 0.25 mm thick, and in some examples, portions at least 0.5 mm thick or even 0.75 mm thick. Additionally or alternatively, if desired, at least the heel support sidewall 402 (and optionally the bottom heel support portion 404 as well) may be made from an unstretchable material. In some examples of this invention, the heel support 400 will be a molded, rigid polymer product (e.g., a TPU) having a Shore D hardness within a range of 50 to 90 Shore D, and in some examples, within a range of 55 to 85 Shore D or even 65 to 80 Shore D.

As shown in FIGS. 3A-3D, this example heel support sidewall 402 is sized and shaped so as to extend only along the first side (medial side 202) of the article of footwear 200 and the bottom heel support portion 404 is sized and shaped so as to extend under only a portion of the plantar surface of a wearer's foot (e.g., supporting a heel and/or midfoot portion of the wearer's foot on the medial side 202 of the article of footwear 200). In some example structures in accordance with aspects of this invention, the heel support sidewall 402 may include a forwardmost edge 402E located in a heel area or a midfoot area of the article of footwear 200 and/or a rearmost edge 402R located in a rear heel area of the article of footwear 200. In the illustrated example of FIGS. 3A-3D, the heel support sidewall 402 forms somewhat of a triangular shaped structure with a top edge 402T (or point) joining the forwardmost edge 402E and the rearmost edge 402R. Alternatively, if desired, the rear portion of the heel support sidewall 402 may extend around to a rearmost heel location RH of the footwear 200 structure, and optionally beyond to the second side (lateral side 204) of the article of footwear 200, e.g., to form somewhat of a heel counter type structure.

In the example structure shown in FIGS. 1A-1I, the forwardmost edge 402E of the heel support sidewall 402 extends to a forwardmost point (402PF) shown by plane P1 in FIG. 1B. Additionally or alternatively, the rearmost edge 402R of the heel support sidewall 402 extends to a rearmost point (402PR) shown by plane P2 in FIG. 1B. In at least some examples of this invention, plane P1 may be located between planes perpendicular to the longitudinal direction of the article of footwear 200 and/or sole structure 220 and located at 0.25 L and 0.45 L, and in some examples, between planes perpendicular to the longitudinal direction of the article of footwear 200 and/or sole structure 220 and located at 0.28 L and 0.42 L. In the example of FIG. 1B, plane P1 is located at approximately 0.37 L. Additionally or alternatively, in at least some examples of this invention, plane P2 may be located between planes perpendicular to the longitudinal direction of the article of footwear 200 and/or sole structure 220 and located at 0 L and 0.15 L, and in some examples, between planes perpendicular to the longitudinal direction of the article of footwear 200 and/or sole structure 220 and located at 0.01 L and 0.08 L. In the example of FIG. 1B, plane P2 is located at approximately 0.04 L.

Figure 1C:
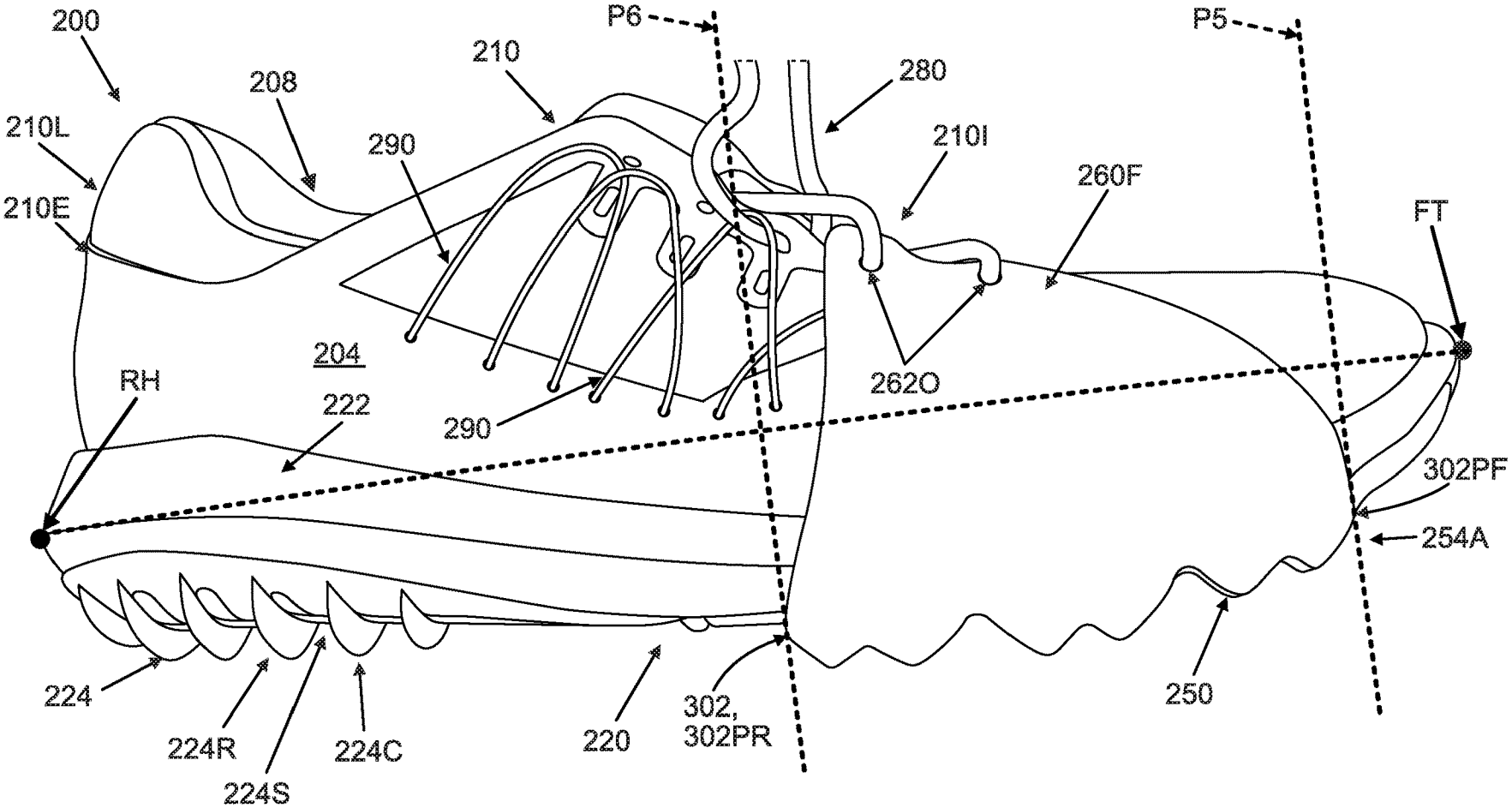
Figure 1D:
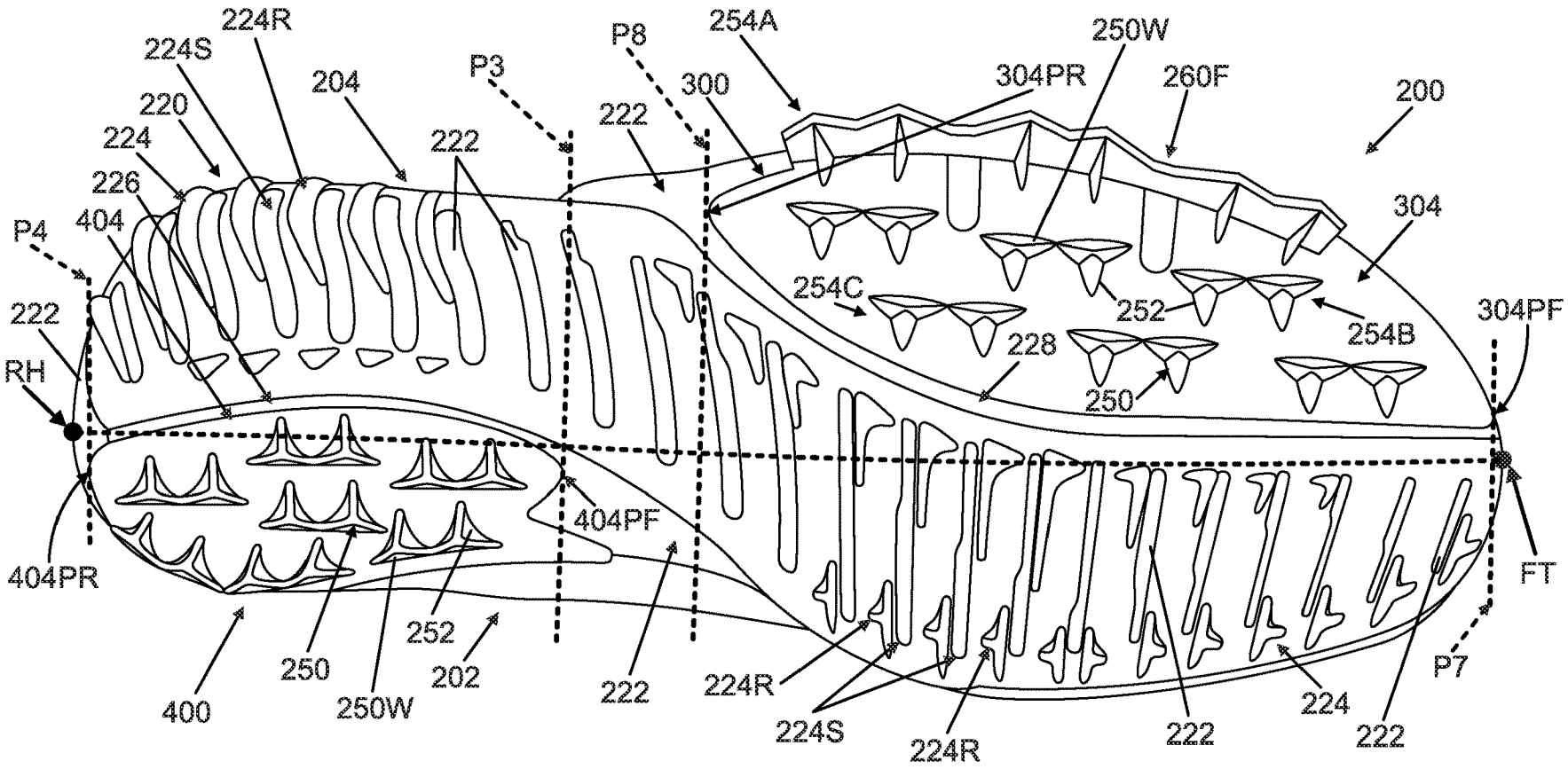

Further, in the example structure shown in FIGS. 1A-1I, the forwardmost edge 404E of the bottom heel support portion 404 extends to a forwardmost point (404PF) shown by plane P3 in FIG. 1D. Additionally or alternatively, the rearmost edge 404R of the bottom heel support portion 404 extends to a rearmost point (404PR) shown by plane P4 in FIG. 1D. In at least some examples of this invention, plane P3 may be located between planes perpendicular to the longitudinal direction of the article of footwear 200 and/or sole structure 220 and located at 0.25 L and 0.45 L, and in some examples, between planes perpendicular to the longitudinal direction of the article of footwear 200 and/or sole structure 220 and located at 0.28 L and 0.42 L. In the example of FIG. 1D, plane P3 is located at approximate 0.35 L. Additionally or alternatively, in at least some examples of this invention, plane P4 may be located between planes perpendicular to the longitudinal direction of the article of footwear 200 and/or sole structure 220 and located at 0 L and 0.15 L, and in some examples, between planes perpendicular to the longitudinal direction of the article of footwear 200 and/or sole structure 220 and located at 0 L and 0.06 L. In the example of FIG. 1D, plane P4 is located at approximate 0.02 L.

This example article of footwear 200 further includes a forefoot support sidewall 302 engaged with at least one of the upper 210 or the sole structure 220 (e.g., at least with midsole 222 in this illustrated example). The forefoot support sidewall 302 may be included as part of a forefoot support 300, e.g., of the type shown in FIGS. 2A-2D, and optionally may include a bottom forefoot support portion 304 for supporting a portion of the plantar surface of a wearer's foot. In the illustrated example, the forefoot support 300 includes: (a) the bottom forefoot support portion 304 forming a second side (e.g., lateral side 204) forefoot plantar support surface at the second side (e.g., lateral side 204) of the article of footwear 200 and (b) the forefoot support sidewall 302 portion extending upward from the bottom forefoot support portion 304. The sidewall 302 portion of the forefoot support 300 includes a rearward edge 302R located in a forefoot area or a midfoot area of the article of footwear 200. The overall forefoot support 300 (including both the forefoot support sidewall 302 and the bottom forefoot support portion 304) may be formed as a unitary, one-piece structure, e.g., from any of the materials described below, potentially in a molding process (e.g., injection molding).

As shown in FIGS. 1A, 1C, and 1D, in this illustrated example, at least some (and optionally, a majority) of the forefoot support sidewall 302 is located between an exterior layer 210E of the upper 210 and a strap 260F (which will be described in more detail below). Alternatively, if desired, the forefoot support sidewall 302 may be at least partially included between layers of the upper 210 and the sole structure 220 and/or may be visible and at least partially exposed (and optionally fully visible and fully exposed) at an exterior of the article of footwear 200 (and outside exterior layer 210E and/or outside of (or otherwise not covered) by strap 260F).

The forefoot support sidewall 302 (and optionally the overall forefoot support 300 along with the bottom forefoot support portion 304) may be formed of a rigid material, such as at least one of a metal material or a molded polymer material (such as a thermoplastic elastomer (e.g., a TPU), a thermoset material, a polyether block amide thermoplastic elastomer, a fiber reinforced plastic material, etc.). In at least some examples of this invention, at least the forefoot support sidewall 302 (and optionally the bottom forefoot support portion 304 as well) may include portions at least 0.25 mm thick, and in some examples, portions at least 0.5 mm thick or even 0.75 mm thick. Additionally or alternatively, if desired, at least the forefoot support sidewall 302 (and optionally the bottom forefoot support portion 304 as well) may be made from an unstretchable material. In some examples of this invention, the forefoot support 300 will be a molded, rigid polymer product (e.g., a TPU) having a Shore D hardness within a range of 50 to 90 Shore D, and in some examples, within a range of 55 to 85 Shore D or even 65 to 80 Shore D.

As shown in FIGS. 2A-2D, this example forefoot support sidewall 302 is sized and shaped so as to extend only along the second side (lateral side 204) of the article of footwear 200 and the bottom forefoot support portion 304 is sized and shaped so as to extend under only a portion of the plantar surface of a wearer's foot (e.g., supporting a forefoot and/or midfoot portion of the wearer's foot on the lateral side 204 of the article of footwear 200). In some example structures in accordance with aspects of this invention, the forefoot support sidewall 302 may include a forwardmost edge 302E located in a forefoot area or a forward toe area of the article of footwear 200 and/or a rearmost edge 302R located in a forefoot area or a midfoot area of the article of footwear 200. In the illustrated example of FIGS. 2A-2D, the forefoot support sidewall 302 forms two side-by-side triangular shaped peaks 302A and 302B (with peak 302A forward of peak 302B). Alternatively, if desired, the forward portion of the forefoot support sidewall 302 may extend around to a forwardmost toe location FT of the footwear 200 structure, and optionally beyond to the first side (medial side 202) of the article of footwear 200.

In the example structure shown in FIGS. 1A-1I, the forwardmost edge 302E of the forefoot support sidewall 302 extends to a forwardmost point (302PF) shown by plane P5 in FIG. 1C. Additionally or alternatively, the rearmost edge 302R of the forefoot support sidewall 302 extends to a rearmost point (302PR) shown by plane P6 in FIG. 1C. In at least some examples of this invention, plane P5 may be located between planes perpendicular to the longitudinal direction of the article of footwear 200 and/or sole structure 220 and located at 0.75 L and 0.95 L, and in some examples, between planes perpendicular to the longitudinal direction of the article of footwear 200 and/or sole structure 220 and located at 0.8 L and 0.93 L. In the example of FIG. 1C, plane P5 is located at approximately 0.9 L. Additionally or alternatively, in at least some examples of this invention, plane P6 may be located between planes perpendicular to the longitudinal direction of the article of footwear 200 and/or sole structure 220 and located at 0.4 L and 0.65 L, and in some examples, between planes perpendicular to the longitudinal direction of the article of footwear 200 and/or sole structure 220 and located at 0.42 L and 0.6 L. In the example of FIG. 1C, plane P6 is located at approximately 0.5 L.

Further, in the example structure shown in FIGS. 1A-1I, the forwardmost edge 304E of the bottom forefoot support portion 304 extends to a forwardmost point (304PF) shown by plane P7 in FIG. 1D. Additionally or alternatively, the rearmost edge 304R of the bottom forefoot support portion 304 extends to a rearmost point (304PR) shown by plane P8 in FIG. 1D. In at least some examples of this invention, plane P7 may be located between planes perpendicular to the longitudinal direction of the article of footwear 200 and/or sole structure 220 and located at 0.90 L and 1.0 L, and in some examples, between planes perpendicular to the longitudinal direction of the article of footwear 200 and/or sole structure 220 and located at 0.94 L and 1.0 L. In the example of FIG. 1D, plane P7 is located at approximately 0.98 L. Additionally or alternatively, in at least some examples of this invention, plane P8 may be located between planes perpendicular to the longitudinal direction of the article of footwear 200 and/or sole structure 220 and located at 0.35 L and 0.55 L, and in some examples, between planes perpendicular to the longitudinal direction of the article of footwear 200 and/or sole structure 220 and located at 0.4 L and 0.5 L. In the example of FIG. 1D, plane P8 is located at approximate 0.44 L.

Figure 5:
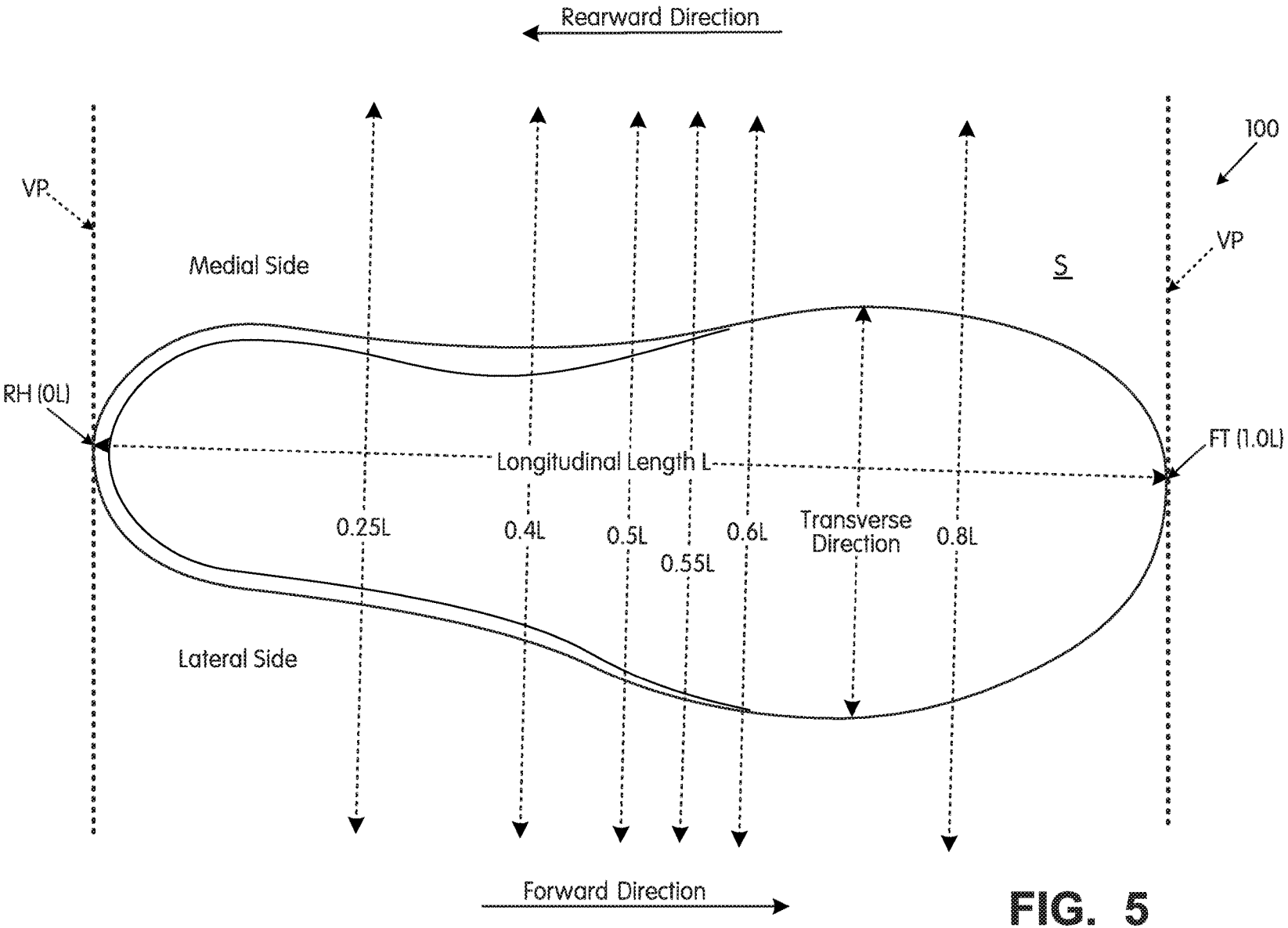
FIG. 5 is provided to help illustrate and explain background and definitional information useful for understanding certain terminology used in this application and aspects of this invention.

In all of the measurements for planes P1 through P8 described above, L is the longitudinal length from the rearmost heel location RH of the article of footwear 200 and/or sole structure 220 to the forwardmost toe location FT of the article of footwear 200 and/or sole structure 220, and the plane location positions are measured forward from the rearmost heel location RH, as described above in conjunction with FIG. 5.

If desired, in at least some examples of this invention, the bottom forefoot support portion 304 of the forefoot support 300 and/or the bottom heel support portion 404 of the heel support 400 may be shaped to fit between layers of the sole structure 220, between layers of the upper 210, and/or between the upper 210 and the sole structure 220. In such instances and structures, the bottom surface(s) of the bottom forefoot support portion 304 and/or the bottom heel support portion 404 may be flat or smoothly contoured.

Alternatively, as shown in the example structures of FIGS. 1A-3D, the bottom forefoot support portion 304 of the forefoot support 300 (optionally with its integrally formed forefoot sidewall portion 302 as a unitary, one-piece construction) and/or the bottom heel support portion 404 of the heel support 400 (optionally with its integrally formed heel sidewall portion 402 as a unitary, one-piece construction) may be formed as part of outsole components configured to directly engage the ground (or other contact surface) in use. FIG. 1D shows heel support 400 provided as an outsole component on a first side (medial side 202 of heel) of the article of footwear 200 with a bottom surface of bottom heel support portion 404 configured to directly engage the ground (or other contact surface) in use. Additionally, FIG. 1D further shows forefoot support 300 provided as an outsole component on a second side (lateral side 204 of forefoot) of the article of footwear 200 with a bottom surface of bottom forefoot support portion 304 configured to directly engage the ground (or other contact surface) in use. Each of these outsole components formed by heel support 400 and forefoot support 300 are engaged with the footwear midsole 222 (e.g., a midsole including one or more of a polymer foam midsole component, a fluid-filled bladder midsole component, a mechanical shock absorbing component, etc.), e.g., by an adhesive or cement.

FIG. 1D further illustrates that this example sole structure 220 includes another outsole component 224 that also may be engaged with the midsole 222, e.g., in any of the manners described above for engaging outsole support parts 300/400 with midsole 222. Outsole component 224 of this illustrated example extends: (a) from the heel area of the article of footwear 200 (e.g., a rear heel area or even a rearmost heel area) at the second side (e.g., only at the lateral side 204) of the article of footwear 200 (b) to the forefoot area of the article of footwear 200 (e.g., a forward toe area or even a forwardmost toe area) at the first side (e.g., only at the medial side 202) of the article of footwear 200. In this manner, the outsole component 224 extends across the midfoot area of the article of footwear and optionally has a "curved" (or even a somewhat "S" shaped) configuration from heel to toe, as shown in FIG. 1D. Outsole component 224 may be made from any desired material, including materials conventionally known and used in footwear outsole constructions, including rigid materials, such as at least one of a metal material or a molded polymer material (such as a thermoplastic elastomer (e.g., a TPU), a thermoset material, a polyether block amide thermoplastic elastomer, a fiber reinforced plastic material, etc.). While the outsole component 224 may have a hardness within the ranges described above for support components 300/400, in some examples of this invention, outsole component 224 may be somewhat softer than components 300/400 (e.g., at least 10% or even at least 20% softer in Shore D number). These softer features may provide added flexibility and/or comfort through the midfoot area, particularly while walking or running. As some more specific examples, outsole component 224 may be made from a rigid polymer material (e.g., by molding) having a hardness in the range of 25 to 60 Shore D, and in some examples, within a range of 30 to 55 Shore D.

FIG. 1D further illustrates that outsole component 224 of this example includes a plurality of rib elements 224R separated by grooves or open spaces 224S. This alternating rib element 224R/space 224S configuration may be provided to control/improve flexibility of outsole component 224 (and thus the overall sole structure 220), and this alternating configuration may be provided over any desired portion or proportion of the sole structure 200. While the example sole structure 220 shown in FIG. 1D has the alternating rib element 224R/space 224S configuration extending throughout the sole structure 220 (from the rear heel area to the forward toe area), the alternating rib element 224R/space 224S configuration could be provided over a smaller portion of the sole structure 220, e.g., in locations where more flexibility as the foot rolls forward during a step or other activities may be desired. As some more specific examples, the alternating rib element 224R/space 224S configuration may be provided in any one or more of: in the lateral heel area; immediately beneath a typical step contact location on the heel (or step "crash pad" location); in the midfoot area; through the arch support area; in the medial forefoot area; immediately beneath the "big toe" area (for "toe off" on a step); and/or through the forward toe area. The rib element (s) 224R may include a traction-enhancing component, such as rubber traction pads, raised traction elements, and/or cleats (e.g., golf cleats (e.g., fin shaped cleats 224C as shown in FIGS. 1B and 1C) integrally formed with a rib element 224R (e.g., during molding of the outsole component 224) and/or releasably engaged with a rib element 224R (e.g., via a mechanical connector, such as a threaded connector)).

While other arrangements and configurations are possible, in this illustrated example, the rib element(s) 224R and the open spaces 224S extend in a substantially transverse direction (e.g., in a direction generally extending between a medial side edge and a lateral side edge of the sole structure 220). The rib elements 224R and open spaces 224S may be oriented, sized, shaped, and/or formed of suitable materials to control the overall flexibility of the outsole component 224 and/or the sole structure 220. As some more specific examples, the rib elements 224R may have a width dimension directly across the rib element 224R (e.g. in the longitudinal direction of the overall sole structure 220, directly from one space 224S to an adjacent space 224S, etc.) between 3 mm and 25 mm (and in some examples, between 4 mm and 20 mm, or even between 5 mm and 16 mm). The spaces 224S may have a width dimension directly across the space 224S (e.g. in the longitudinal direction of the overall sole structure 220, directly from one rib element 224R to an adjacent rib element 224R, etc.) between 2 mm and 25 mm (and in some examples, between 3 mm and 20 mm, or even between 4 mm and 16 mm). The rib element 224R width and/or space 224S width may vary or may remain constant over an end-to-end length of the specific rib element 224R and/or space 224S. Additionally or alternatively, rib element 224R width and/or space 224S width may vary or may remain constant over two or more of a plurality of rib elements 224R and/or a plurality of spaces 224S in a given outsole component 224 (i.e., the rib element 224R and/or each space 224S of a given outsole component 224 may have the same widths or different widths). In this illustrated example, the bottom surface of midsole 222 is exposed at the exterior surface of the sole structure and exposed to ground contact within the open spaces 224S.

As evident from the discussion above and FIG. 1D, the ground-contacting portion of the sole structure 220 of this example article of footwear 200 includes three outsole components, namely: bottom heel support portion 404 (which may be integrally formed as part of heel support 400 and/or heel support sidewall 402); bottom forefoot support portion 304 (which may be integrally formed as part of forefoot support 300 and/or forefoot support sidewall 302); and outsole component 224. As shown in FIG. 1D, at the heel area of the article of footwear 200/sole structure 220, the outsole component 224 is separated from a first side edge (e.g., separated from the sole sidewall at the medial side 202) of the sole structure 220 by the heel support 400 (by the outsole component forming bottom heel support portion 404). In this manner, the bottom heel support portion 404 forms a portion of an exposed, bottom surface of the article of footwear 200 in the heel area and extends partially across the exposed bottom surface of the article of footwear 200 in a direction from the first side (medial side 202) toward the second side (lateral side 204). The bottom heel support portion 404 separates outsole component 224 from the first (medial) side edge of the sole structure 220. A space 226 may be provided between the outsole component 224 and the bottom heel support portion 404, and this space 226 may support or enhance flexibility of the sole structure (e.g., along a generally longitudinal axis between outsole component 224 and bottom heel support portion 404). The bottom surface of midsole 222 may be visible and/or exposed to ground contact at the exterior of the sole structure 220 in space 226.

Additionally or alternatively, at the forefoot area of the article of footwear 200/sole structure 220, the outsole component 224 is separated from a second side edge (e.g., separated from the sole sidewall at the lateral side 204) of the sole structure 220 by the forefoot support 300 (by the outsole component forming bottom forefoot support portion 304). In this manner, the bottom forefoot support portion 304 forms a portion of an exposed, bottom surface of the article of footwear 200 in the forefoot area and extends partially across the exposed bottom surface of the article of footwear 200 in a direction from the second side (lateral side 204) toward the first side (medial side 202). The bottom forefoot support portion 304 separates outsole component 224 from the second (lateral) side edge of the sole structure 220. A space 228 may be provided between the outsole component 224 and the bottom forefoot support portion 304, and this space 228 may support or enhance flexibility of the sole structure (e.g., along a generally longitudinal axis between outsole component 224 and bottom forefoot support portion 304). The bottom surface of midsole 222 may be visible and/or exposed to ground contact at the exterior of the sole structure 220 in space 228.

When provided as exposed bottom components and/or outsole component(s), a bottom surface 404B of the bottom heel support portion 404 of the heel support 400 and/or a bottom surface 304B of the bottom forefoot support portion 304 of the forefoot support 300 may include one or more traction elements, such as one or more cleats 250 (e.g., directional cleats and/or torsion inhibiting cleats) extending in a direction away from the bottom surface 304B/404B of the bottom forefoot/heel support portion 304/404. FIGS. 1D, 1H, and 1I illustrate examples of some potential cleat structures 250 formed as directional cleats and/or torsion inhibiting cleats and provided in articles of footwear 200, sole structures 220, heel supports 400, and/or forefoot supports 300 in accordance with at least some examples of this invention. As shown in these figures (as well as FIGS. 2C, 2D, 3D, 4E, and 4F), at least one cleat 250 of the one or more cleats extending from the bottom heel support portion 404 and/or the bottom forefoot support portion 304 includes a substantially flat and/or a substantially vertical wall surface 250W, and this wall surface 250W optionally may have a substantially triangular shape. In the bottom heel support portion 404, this substantially flat and/or substantially vertical wall surface 250W faces the first side (e.g., medial side 202) of the article of footwear 200 and the sole structure 220. In the bottom forefoot support portion 304, this substantially flat and/or substantially vertical wall surface 250W faces the second side (e.g., lateral side 204) of the article of footwear 200 and the sole structure 220. As shown in FIGS. 1D, 1H, and 1I, the cleats 250 may be arranged to have closely located or even adjoined pairs (or even adjoined larger sets) of cleats 250 (optionally with one or more (or even all) of the closely located or adjoined cleats having a substantially flat and/or a substantially vertical wall surface 250W). "Closely located" cleats 250 as that term is used herein in this context includes cleats having their adjacent edges located with 0 to 20 mm of one another, and in some examples, within 0 to 16 mm of one another or even within 0 to 12 mm of one another.

During a golf swing (or other activities), a torsional force may be applied by a wearer's leg to a foot and/or article of footwear, e.g., as the golfer transitions from set up to the back swing and/or as the golfer transitions from the back swing to the front swing and/or to a follow through position. The substantially flat and/or substantially vertical wall surface(s) 250W, e.g., located at the lateral forefoot and medial heel areas of the sole structure 220, sink into the ground and provide a solid surface to engage the ground and inhibit rotational motion of the foot in one direction during some phases of the golf swing (or other activities). More specifically, the substantially flat and/or substantially vertical wall surface(s) 250W on the bottom forefoot support portion 304 (or other outsole member), when present, help prevent the wearer's forefoot from rotating outward when a torsional force is applied in that direction by the wearer's leg. Similarly, the substantially flat and/or substantially vertical wall surface(s) 250W on the bottom heel support portion 404 (or other outsole member), when present, help prevent the wearer's heel from rotating inward when a torsional force is applied in that direction by the wearer's leg. For these reasons, in this illustrated example, the forefoot cleats 250 have their substantially flat and/or substantially vertical surfaces 250W facing the lateral side 204 (e.g., on cleats 250 located closer to the lateral side 204 than to the medial side 202 of the sole structure 220/article of footwear 200). Additionally or alternatively, the heel cleats 250 have their substantially flat and/or substantially vertical surfaces 250W facing the medial side 202 (e.g., on cleats 250 located closer to the medial side 202 than to the lateral side 204 of the sole structure 220/article of footwear 200).

If necessary, in order to provide further support for the cleat 250's substantially flat and/or substantially vertical wall surface(s) 250W when exposed to a torsional force, the side 250O of the cleat 250 opposite the substantially flat and/or substantially vertical wall surface(s) 250W may include a support structure 252. In the illustrated examples, the support structure 252 constitutes a rib type structure that extends from the cleat surface opposite the substantially flat and/or substantially vertical wall surface(s) 250W, e.g., from a location at or near the cleat 250's ground engaging edge 250G, to the bottom surface 304B/404B of the forefoot support 300/heel support 400. This support structure 252 provides reinforcement behind the wall 250W to counteract the anticipated torsional force and to help prevent the cleat 250 from collapsing or folding along its base surface 250B when the torsional forces are applied. The support structure 252 also may help prevent collapse of the cleat 250 when contacting the ground during a step or jump.

While other arrangements are possible, in this illustrated example structure, forefoot support 300 includes three generally longitudinally arranged rows of primary cleats, with all of these primary cleats being cleats 250 with substantially flat and/or substantially vertical wall surface(s) 250W facing the lateral side 204 of the article of footwear 200/sole structure 220. The cleats 250 are arranged in three generally longitudinally arranged rows 254A, 254B, 254C of cleats 250, with each row in this example structure having three "adjoined" pairs of cleats, e.g., of the types shown in FIGS. 1H and 1I (for a total of six cleats 250 with substantially vertical and/or substantially flat sidewall surfaces 250W in each longitudinal row 254A, 254B, 254C). The outer row 254A of cleats 250 of the forefoot support 300 are arranged to form the outer lateral forefoot edge of the sole structure 220 and the article of footwear 200 (with the substantially flat and/or substantially vertical wall surfaces 250W of this outer row 254A of cleats 250 facing outward and away from the sole structure 220 and extending substantially continuously and/or flush with the outer surface of the forefoot support sidewall 302). Similarly, the heel support 400 may include one or more generally longitudinally arranged rows of primary cleats, optionally with all of the primary cleats on the heel support 400 being cleats 250 with substantially flat and/or substantially vertical wall surface(s) 250W facing the medial side 202 of the article of footwear 200/sole structure 220. The cleats 250 of the heel support 400 also may be arranged as "adjoined" pairs (or adjoined larger groupings) of cleats, e.g., of the types shown in FIGS. 1H and 1I. The outer row 256 of cleats 250 of the heel support 400 in this example are arranged to form the outer medial heel edge of the sole structure 220 and the article of footwear 200 (with the substantially flat and/or substantially vertical wall surfaces 250W of this outer row 256 of cleats 250 facing outward and away from the sole structure 220 and extending substantially continuously and/or flush with the outer surface of the heel support sidewall 402).

Features of strap systems and securing systems for articles of footwear in accordance with examples of the invention now will be described. One example strap system is shown in the embodiment of FIGS. 1A-1I, and another example strap system is shown in the embodiment of FIGS. 4A-4G. When the same reference numbers are used in FIGS. 4A-4G as those used in FIGS. 1A-3D, the same or similar parts are being referred to (including any of the various options and/variations for those parts) as described for the embodiment of FIGS. 1A-3D, and some or all of the repetitive disclosure of these same/similar parts then may be omitted. The footwear upper 210 and/or sole structures 220 shown in the embodiment of FIGS. 4A-4G may have any of the features, characteristics, components, and/or variations as described for the embodiment of FIGS. 1A-1I, including any of the features of forefoot support 300, heel support 400, outsole component 224, and/or cleats 250.

Figure 1E:
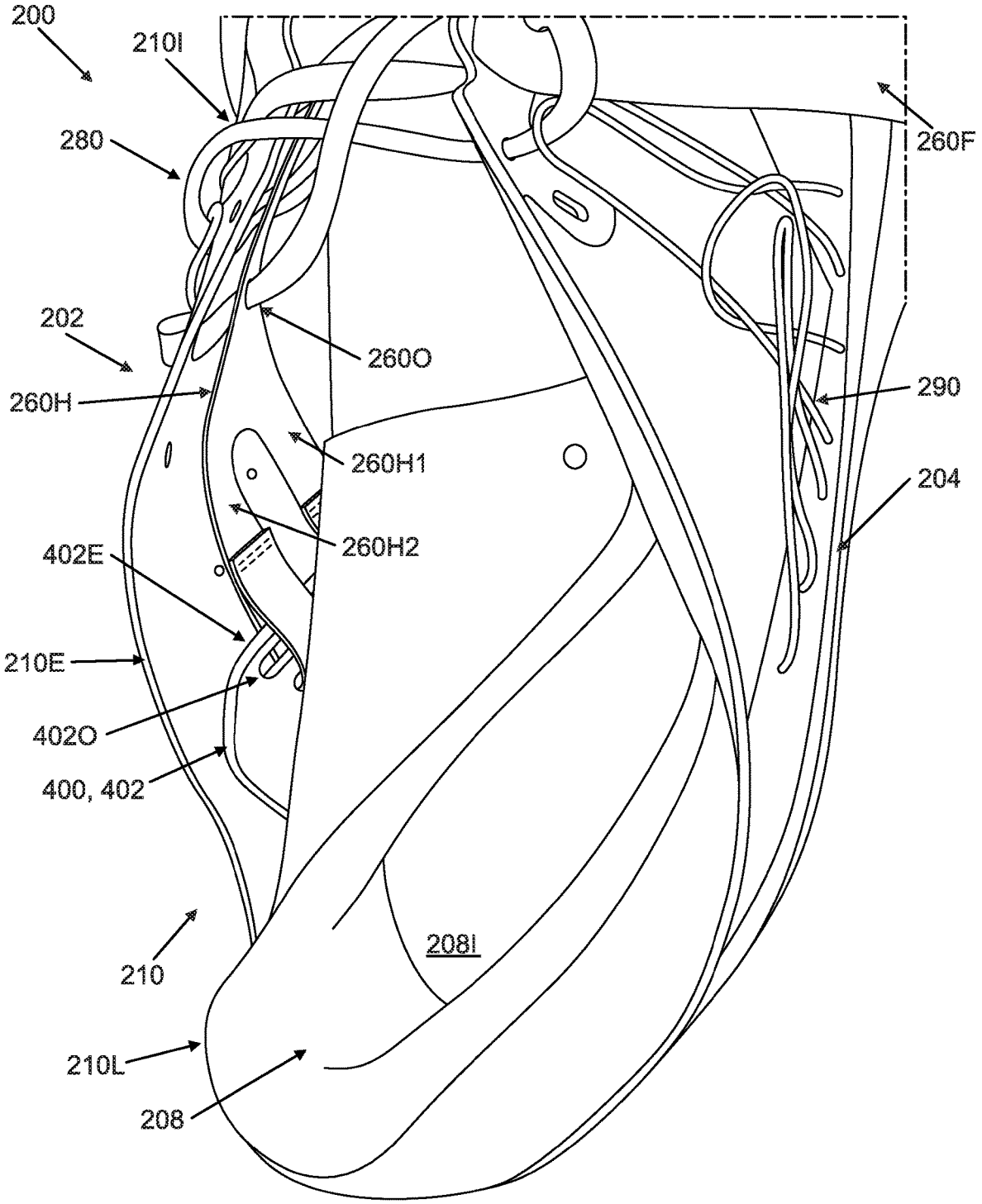
Figure 1F:
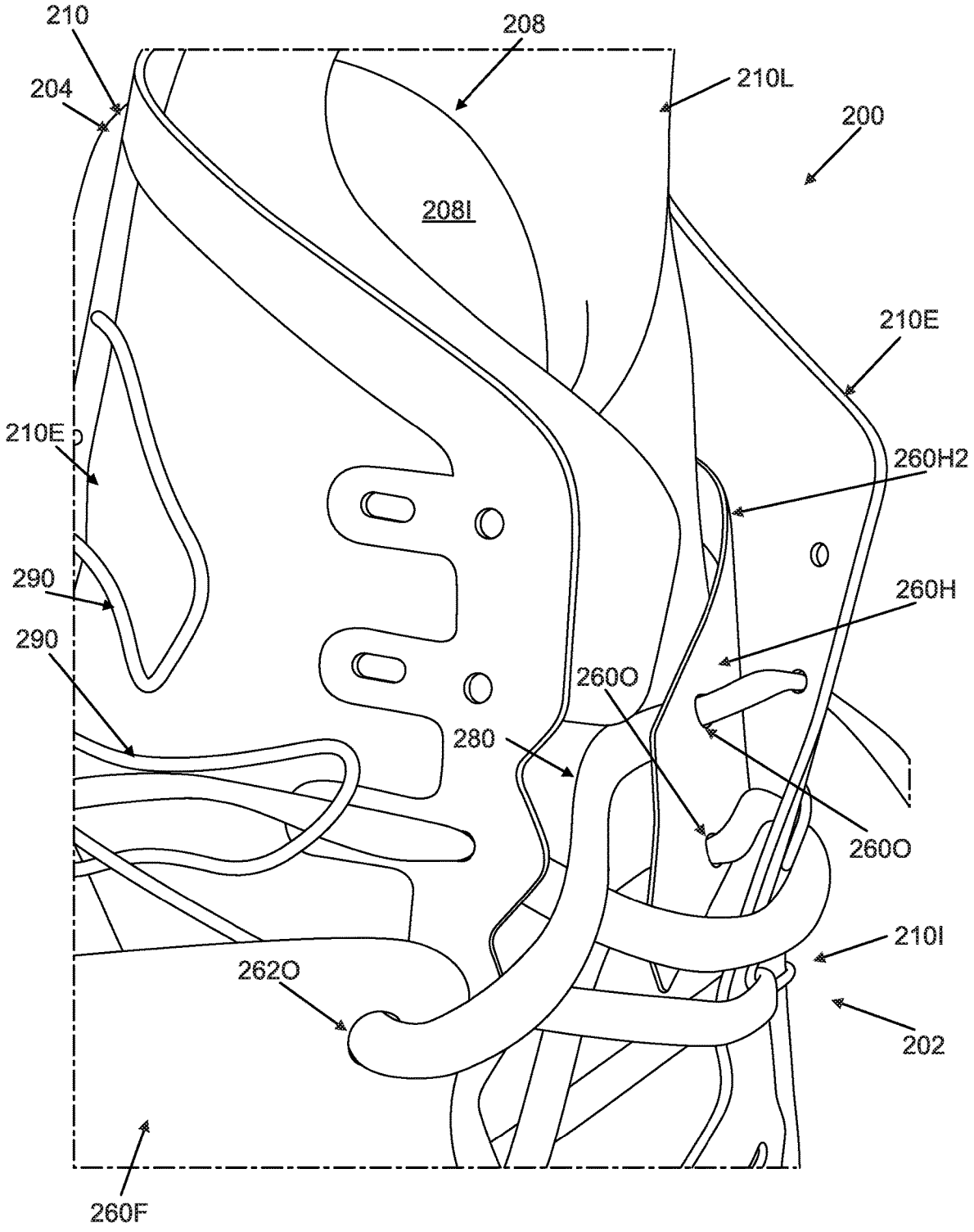
Figure 1G:
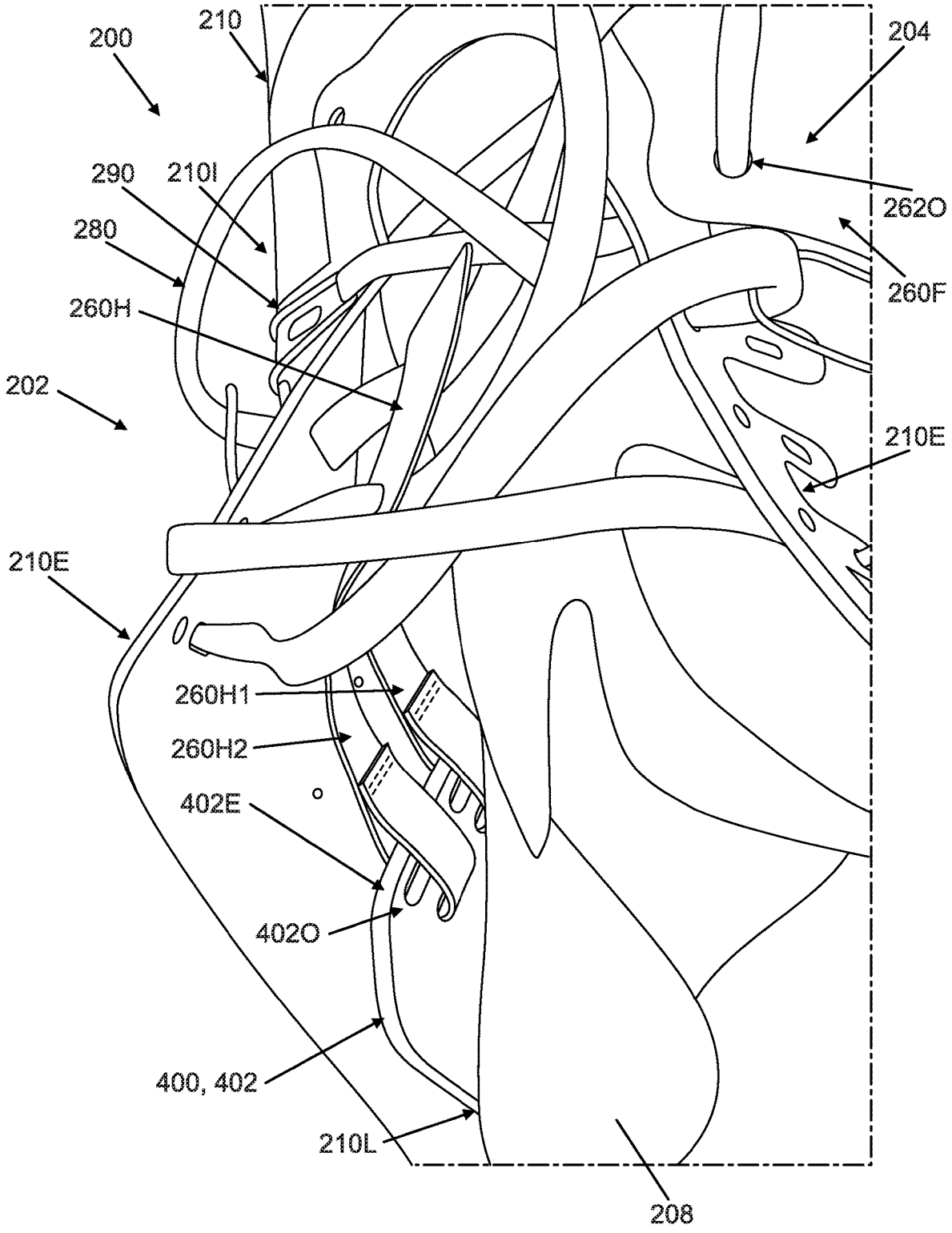
Figure 1I:
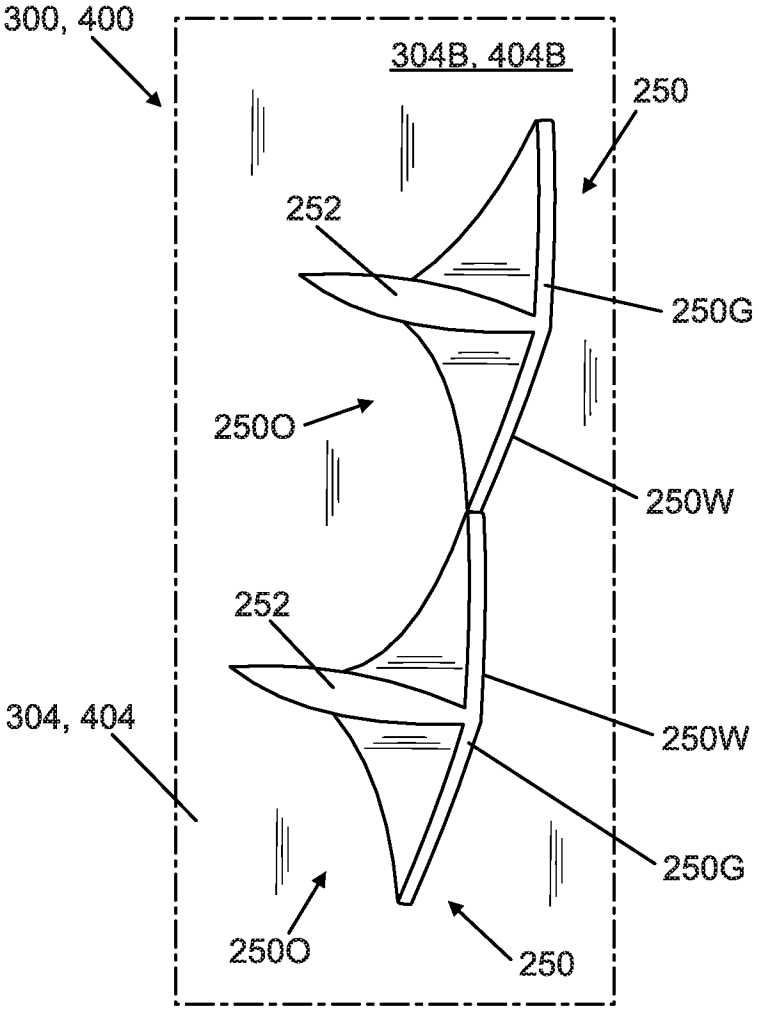
Figure 1H:
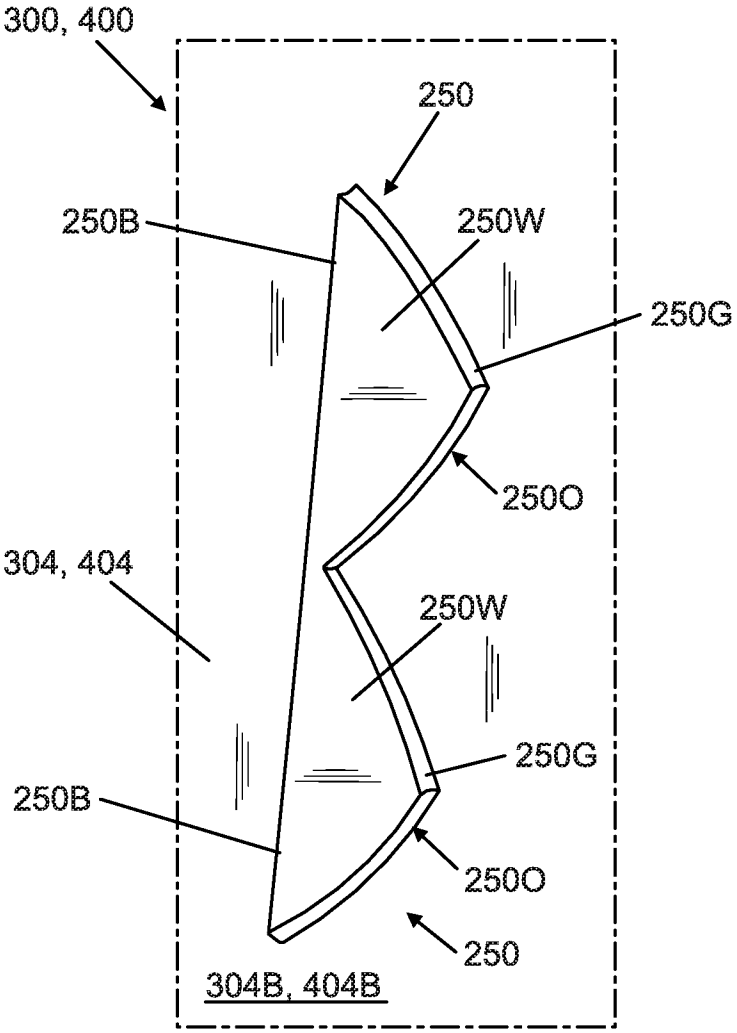
Figure 2A:
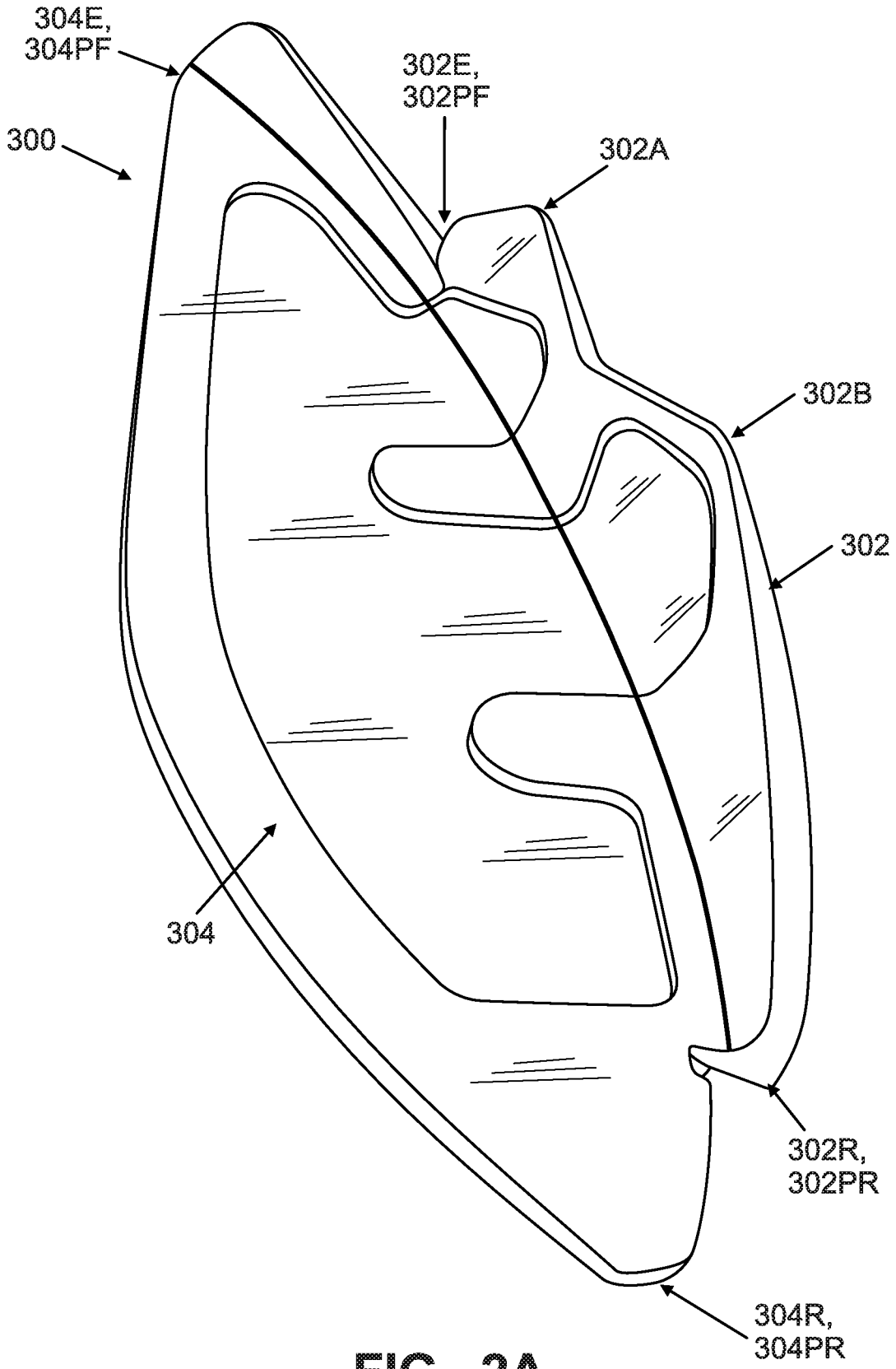
FIGS. 2A through 2D provide various views of an example forefoot support that may be used in articles of footwear in accordance with at least some examples of this invention.
Figure 2B:
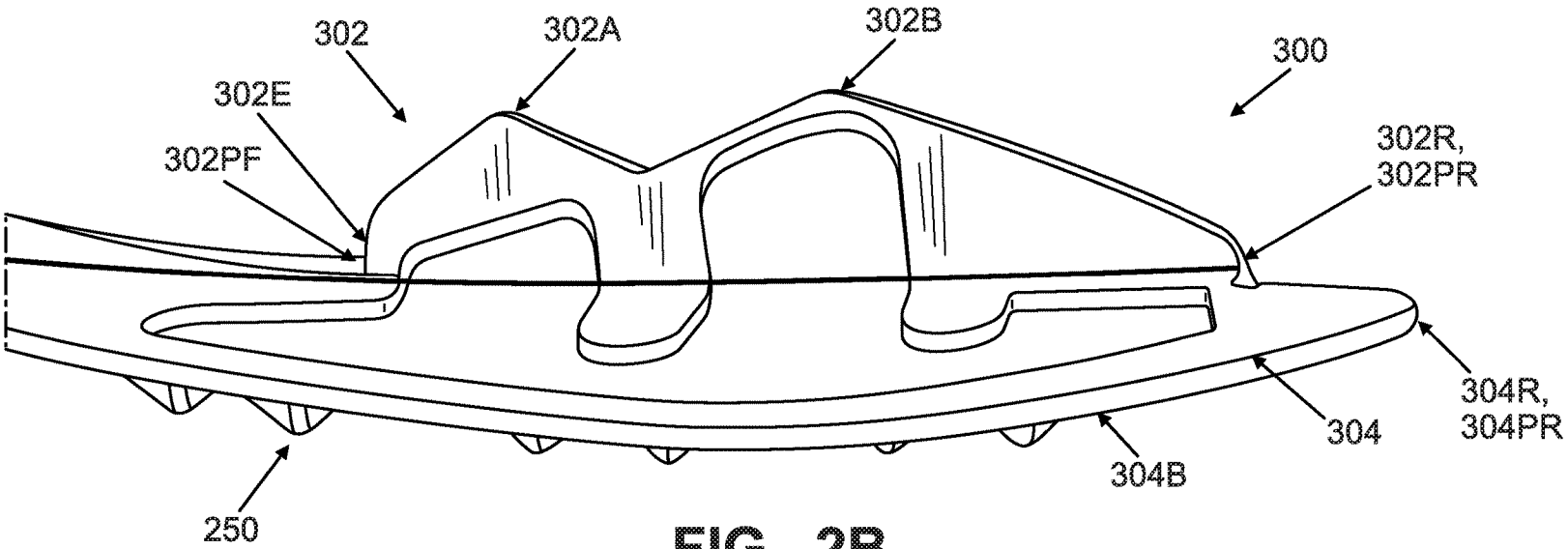
Figure 2C:
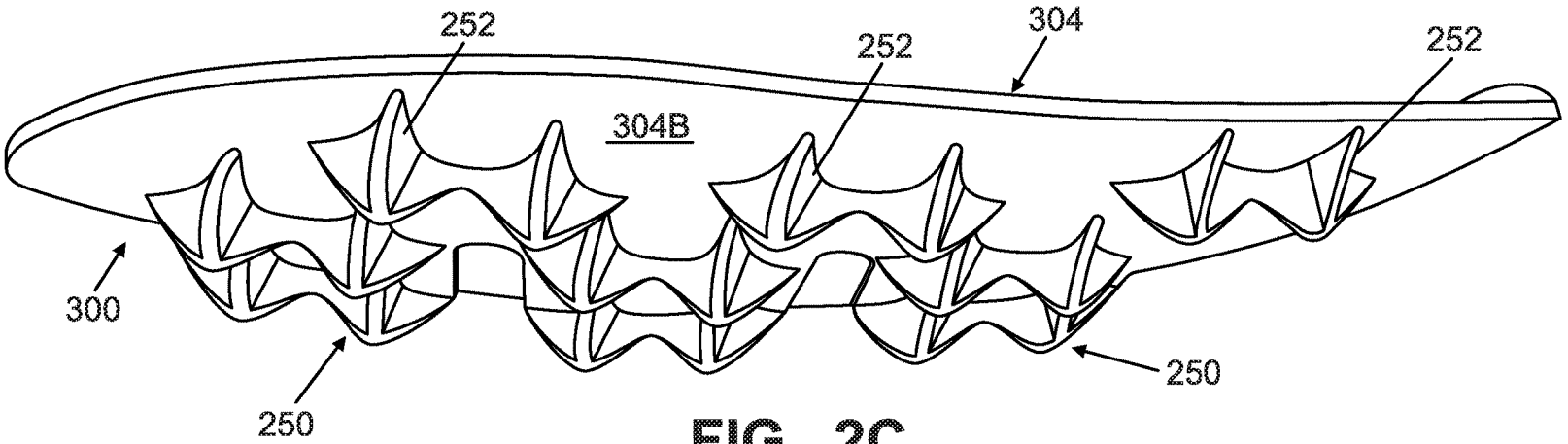
Figure 2D:
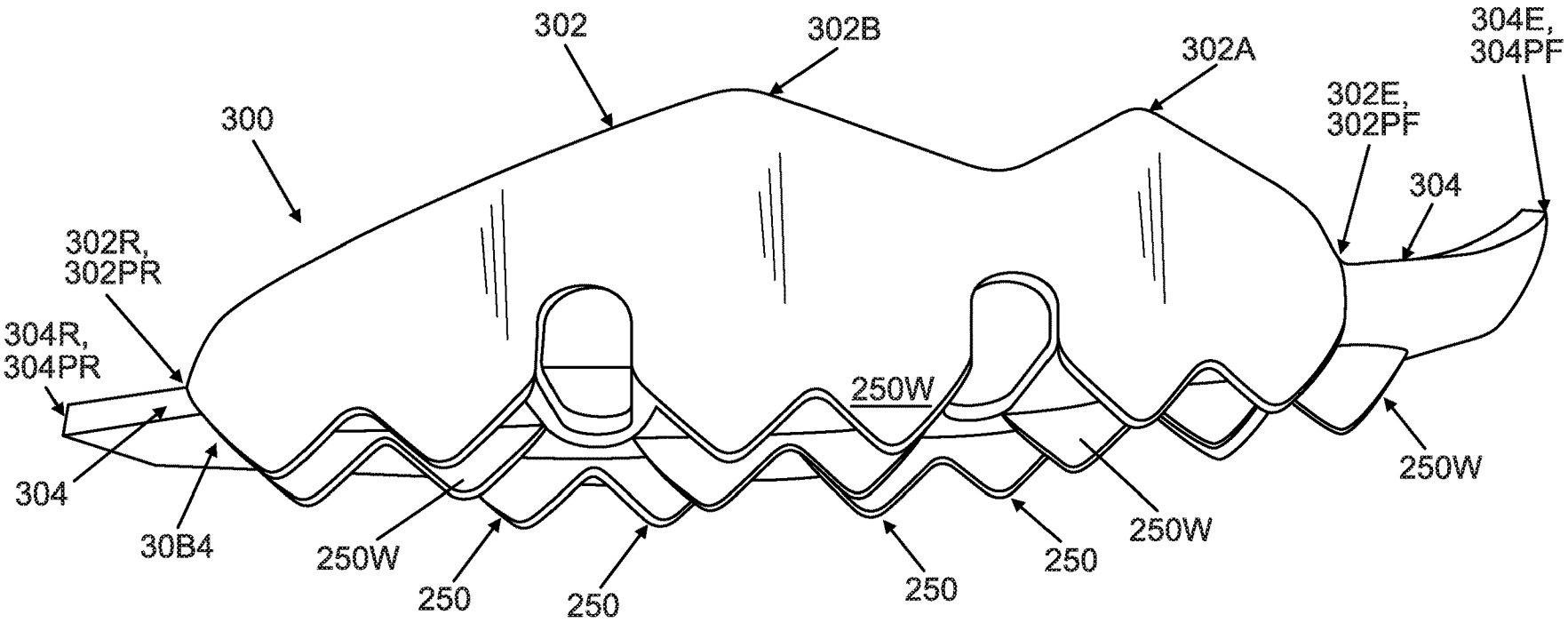
Figure 3A:
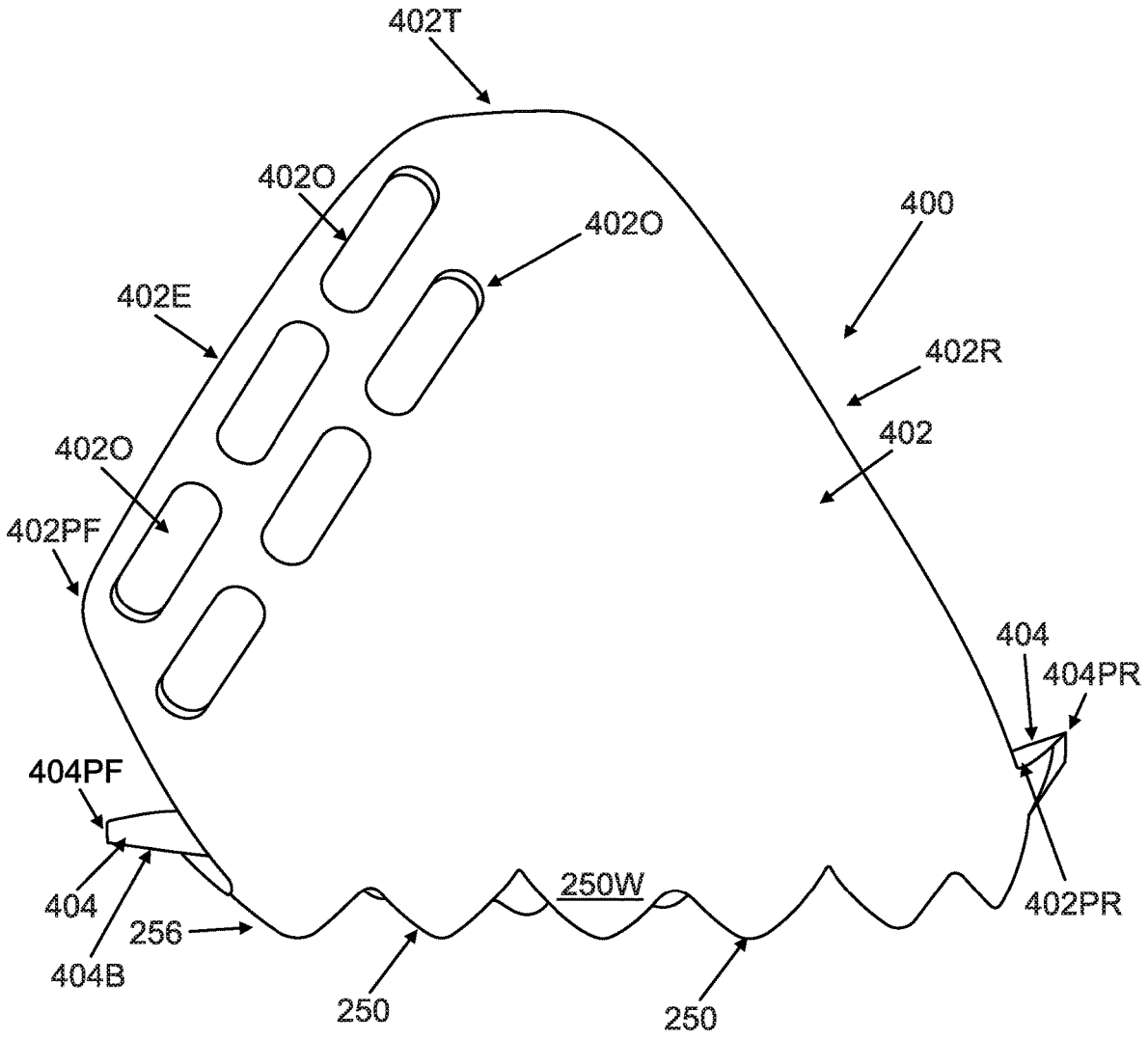
FIGS. 3A through 3D provide various views of an example heel support that may be used in articles of footwear in accordance with at least some examples of this invention.
Figure 3B:
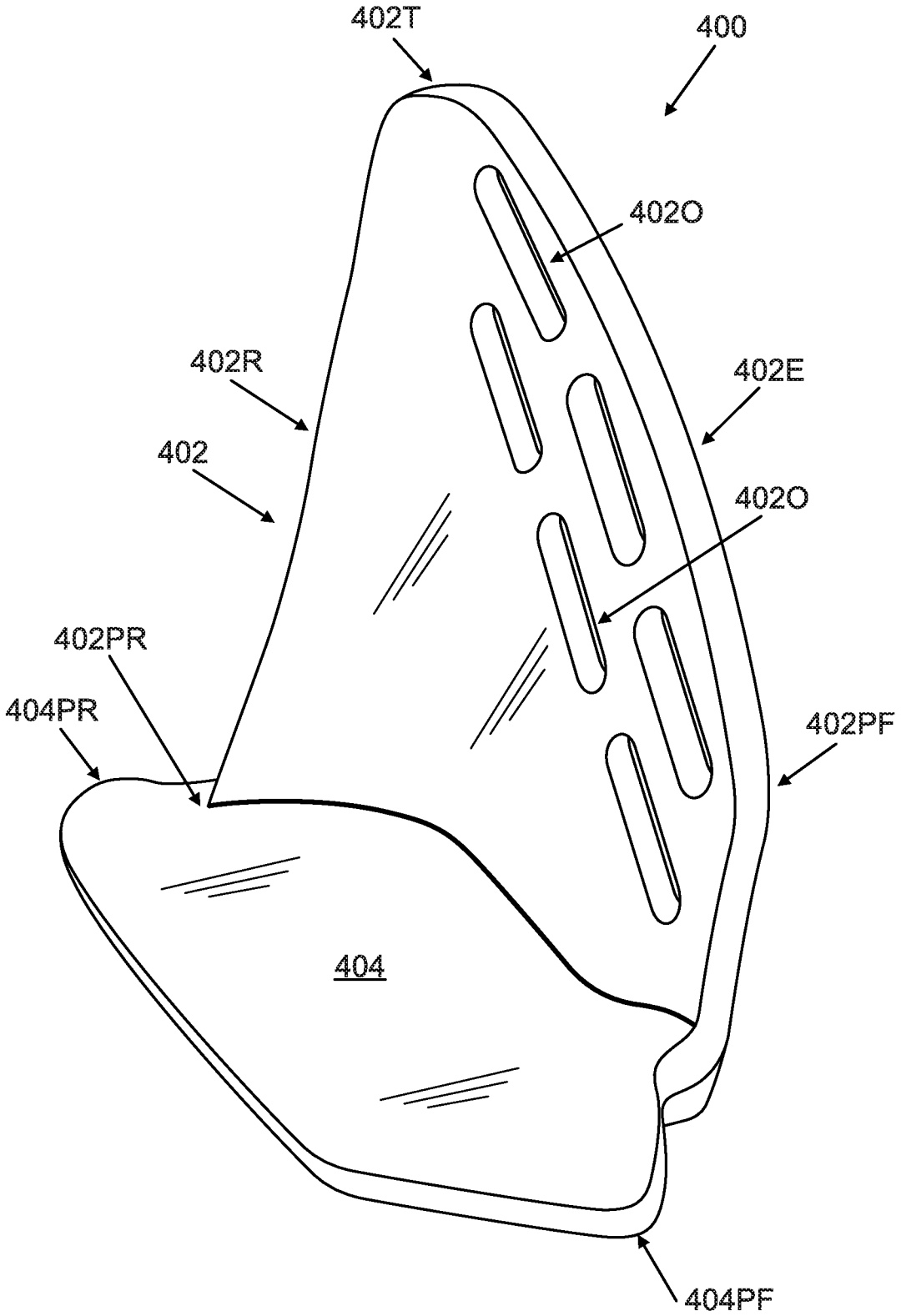
Figure 3C:
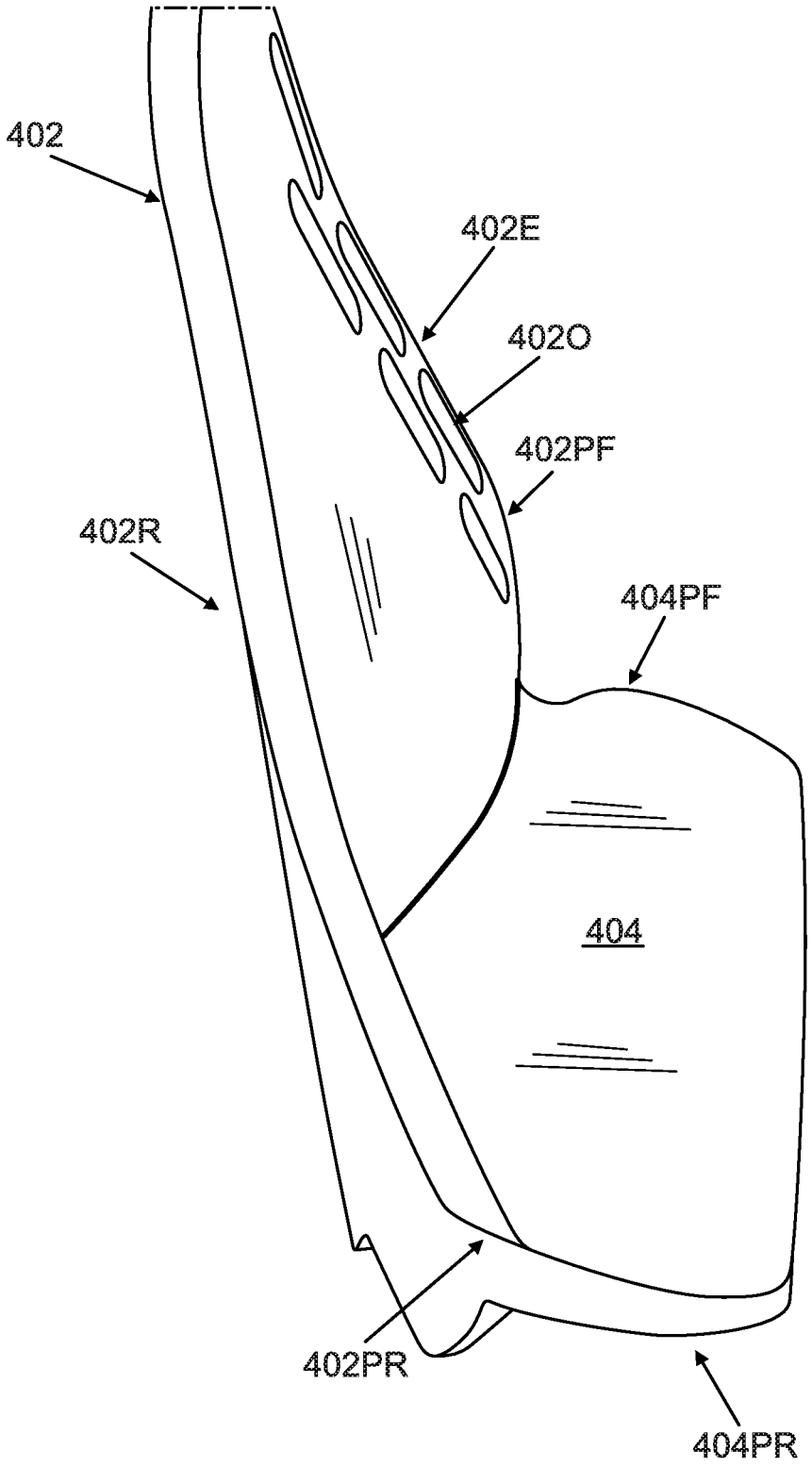
Figure 3D:
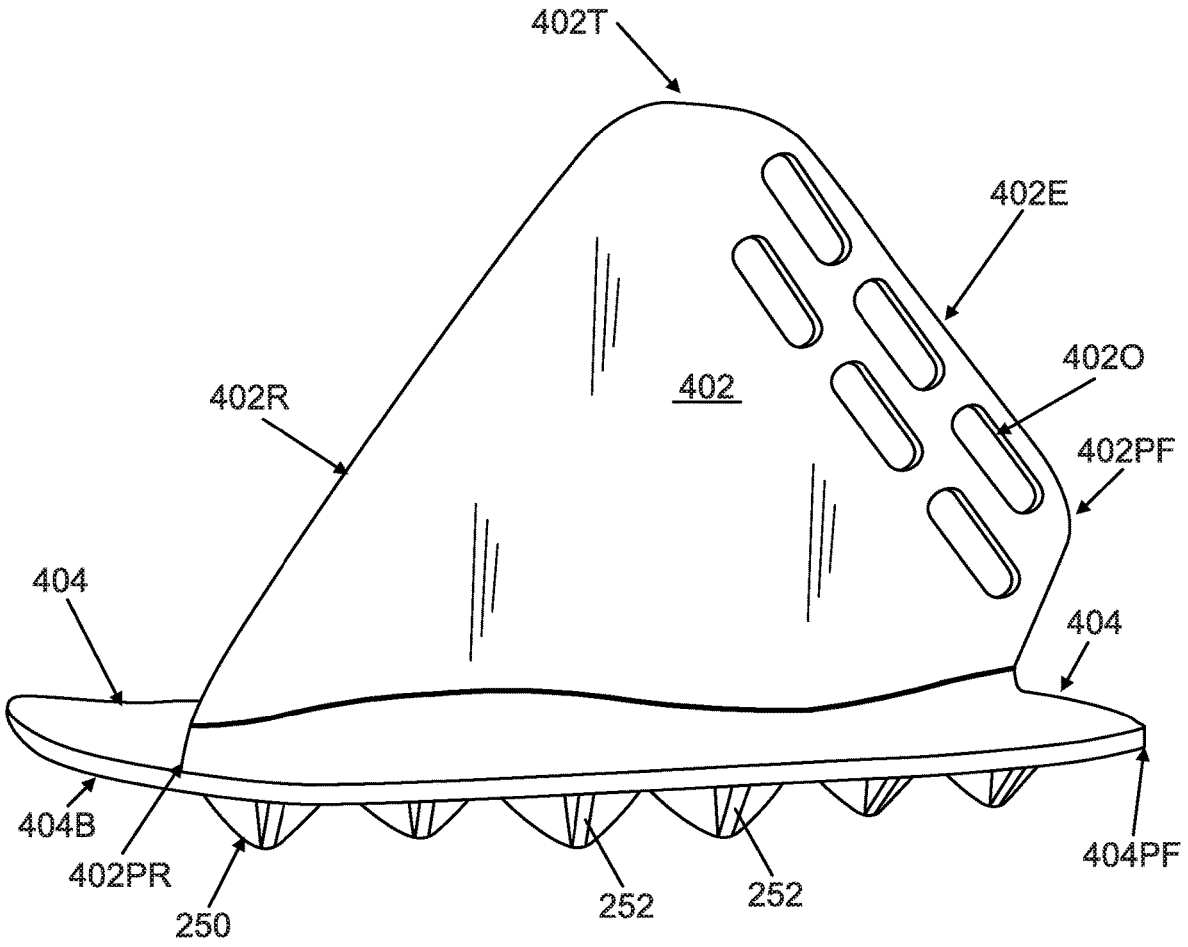

The footwear 200 structure of FIGS. 1A-1I includes a strap system for engaging and securing the footwear 200 to a wearer's foot. While other arrangements are possible, in this illustrated example, the strap system connects the heel support sidewall 402 and the forefoot support sidewall 302 across an instep portion 210I of the upper 210. This example strap system includes a first strap 260H engaged with the heel support sidewall 402 and a second strap 260F engaged with the forefoot support sidewall 302. While any desired manner of connecting the straps 260H/260F with their respective sidewalls 402/302 may be used without departing from this invention, in this illustrated example, one or more portions of first strap 260H are looped through openings 402O provided in the heel support sidewall 402 and then sewn to close the loop. Two such strap portions (260H1 and 260H2) are shown in FIGS. 1E and 1G. As shown in FIGS. 3A-3D, the openings 420O may be located at or near the forward edge 402E of the heel support sidewall 402. Additionally or alternatively, if desired, the first strap 260H may be engaged with the heel support sidewall 402 in a different manner, such as using an adhesive or cement, a mechanical connection (e.g., a snap or buckle, a sewn seam, a knot, etc.), a co-molding process (e.g., embedding one end of the strap material into the material of the sidewall 402 when the sidewall 402 is molded), or the like. This example strap 260H may be made from an unstretchable fabric or polymer material (e.g., optionally including wires or tensile fibers to limit stretch). The tear strength of strap 260H (and any other strap or strap portion described herein) may be at least 40 kg (and in some examples, at least 60 kg).

The end of the first strap 260H opposite from its connection to the heel support sidewall 402 in this illustrated example includes one or more openings 260O for engaging a lace 280 of the article of footwear 200. The openings 260O in the first strap 260H may be positioned (e.g., axially aligned) to match up to corresponding lace openings 280O provided in the footwear upper 210 so that when the lace 280 is pulled tight, this tightening force will move the outer surface of strap 260H with respect to the inner surface of the upper 210 (e.g., interior surface of upper exterior component 210E) so that these surfaces lie adjacent and in contact with one another (e.g., lie flush against one another). These features help the first strap 260H better conform to the shape of the wearer's foot when the lace 280 is tightened.

Features of the second strap 260F of this illustrated example footwear 200 structure now will be described. In this example, an inner surface of second strap 260F is engaged with an outer surface of forefoot support sidewall 302 by an adhesive or cement. Alternatively, if desired, a mechanical connection may be used (e.g., like the connection between strap 260H and heel support sidewall 402, a snap or buckle, a sewn seam, a knot, a rivet, etc.). As another potential option, a co-molding process (e.g., embedding one end of the strap material into the material of the forefoot support sidewall 302 when the forefoot support sidewall 302 is molded) could be used to engage the second strap 260F with forefoot support sidewall 302. As further shown in various figures, the end of the second strap 260F opposite from its connection to the forefoot support sidewall 302 in this illustrated example includes one or more openings 262O for engaging the lace 280 of the article of footwear 200. The openings 262O in the second strap 260F may be positioned (e.g., axially aligned) to match up to corresponding lace openings 280O provided in the footwear upper 210 so that when the lace 280 is pulled tight, this tightening force will move the inner surface of strap 260F with respect to the outer surface of the upper 210 (e.g., exterior surface of upper exterior component 210E) so that these surfaces lie adjacent and in contact with one another (e.g., to lie flush against one another). This example strap 260F may be made from an unstretchable fabric or polymer material (e.g., optionally including wires or tensile fibers to limit stretch). The tear strength of strap 260F may be at least 40 kg (and in some examples, at least 60 kg).

In use, the lace 280 acts as a securing system for releasably holding at least one (and preferably both) of the first strap 260H and the second strap 260F in a tightened condition. The lace 280 also joins and/or holds the two straps 260H/260F together and tightens the straps 260H/260F around the wearer's foot. In some example structures in accordance with aspects of this invention, the lace 280 may be oriented through axially aligned openings 260O, 262O in the straps 260H and 260F and the openings 280O in the upper 210 so that one lace 280 segment 280F extends across the instep area 210I of the upper 210 directly from the forwardmost opening 262O in strap 260F to the forwardmost opening 260O in strap 260H and so that one lace 280 segment 280R extends across the instep area 210I of the upper 210 directly from the rearmost opening 262O in strap 260F to the rearmost opening 260O in strap 260H (see FIG. 1A). In this manner, as shown in FIG. 1A, the lace segments 280F and 280R extend substantially in parallel and are angled across the instep area 210I of the upper 210 in a forward lateral-to-rear medial direction. In this arrangement, the lace 280 most directly pulls straps 260F and 260H toward one another and/or most directly pulls forefoot support sidewall 302 and heel support sidewall 402 toward one another. This arrangement provides a secure feel to the wearer.

FIGS. 1A-1C and 1E-1G further show article of footwear 200 including foot stabilizer elements 290, engaged by the lace 280, that may at least partially wrap around the wearer's foot. These foot stabilizer elements 290 can adaptively conform the upper 210 to the shape of the wearer's foot and help securely hold the upper 210 to the wearer's foot. The foot stabilizer elements 290 of this example are tensile strands (e.g., substantially unstretchable) extending from upper 210/sole structure 220 interface toward the instep opening of the upper 210 (by the tongue) and form loops that can engage the lace 280 and move with the lace 280 as the lace 280 is tightened. Such foot stabilizer elements 290 are known and used in the footwear arts, e.g., including elements of the types described, for example, in U.S. Pat. Nos. 8,869,435 B2 and/or 9,282,784 B2, which patents are each entirely incorporated herein by reference. Any of the foot stabilizer structures shown in these patents can be used in conjunction with footwear according to aspects of this invention.

While FIGS. 1A-1I show strap 260H inside the upper 210 and/or between layers of the upper 210, some or all of the strap 260H may be located outside of the exterior surface of the upper 210. Additionally or alternatively, while FIGS. 1A-1I show strap 260F outside the upper 210 and outside of foot support sidewall 302, some or all of the strap 260F may be located inside of the exterior surface of the upper 210, between layers of the upper 210, and/or inside the forefoot support sidewall 302. As other options, if desired, each of straps 260H and/or 260F may be formed as two or more separate straps and/or as a single strap having different strap portions extending from a common base area. Any desired strap structure may be used without departing from at least some aspects of this invention.

Rather than a conventional shoe lace type structure, if desired, the securing system for the example of the invention shown in FIGS. 1A-1I may include a wire or other elongated tensile element structure or strap that extends between and connect straps 260F/260H and optionally connects opposite sides of the instep opening of upper 210 (e.g., across a tongue component). Some examples may include releasable dial and/or ratchet type footwear securing structures that releasably take up slack in a wire or other tensile element that extends across an instep area in a manner similar to a lace.

FIGS. 4A-4G provide various views of another example article of footwear 500 structure in accordance with some aspects of this invention. As noted above, when the same reference numbers are used in FIGS. 4A-4G as those used in FIGS. 1A-3D, the same or similar parts are being referred to (including any of the various options and/variations for those parts) as described for the embodiment of FIGS. 1A-3D, and some or all of the repetitive disclosure and description of these same/similar parts then may be omitted.

One difference between the article of footwear 500 of FIGS. 4A-4G as compared to the article of footwear 200 of FIGS. 1A-1I relates to various strap system features. While the article of footwear 500 embodiment of FIGS. 4A-4G still includes two separate straps, in this article of footwear 500, the first strap 560H directly engages the second strap 560F. Also, while FIGS. 4A-4G show an article of footwear 500 that includes a conventional lace component 280 beneath the strap system, if desired, the lace component 280 could be omitted (e.g., and the straps 560H/560F may be the primary or sole feature securing the article of footwear 500 to the wearer's foot).

As shown in these figures, the first strap 560H includes two adjacent strap portions 560H1 and 560H2 engaged with openings 402O provided at the forward edge 402E of the heel support sidewall 402 of heel support 400. One or more fixed connections may be provided at the ends of strap portions 560H1 and/or 560H2 to engage the strap portion(s) 560H1/560H2 with the heel support sidewall 402. For example, one end of the first strap 560H (e.g., each of strap portions 560H1 and 560H2) may be engaged with the heel support sidewall 402 of heel support 400 in any desired manner, including any of the various manners described above for engaging first strap 260H with heel support sidewall 402 of FIGS. 1A-1I (e.g., by adhesives or cements, by looping the strap portions through the openings 402O, by mechanical connectors, by a sewn seam, by a molded attachment connection, etc.). The other end of the first strap portion 560H is a free end, which in this illustrated example includes a base area 566 to which the free ends of strap portions 560H1 and 560H2 are engaged. In this example article of footwear 500 structure, the heel support sidewall 402 is located outside of the exterior surface 210E of upper 210.

The free ends of strap portions 560H1 and 560H2 of this example are threaded through openings 560F1 and 560F2 provided in the free end 562 of the second strap 560F. Once threaded through, the base area 566 is engaged with and connects to strap portions 560H1 and 560H2 to prevent the strap portions 560H1 and 560H2 from pulling out of openings 560F1 and 560F2 and disengaging from second strap 560F. The other end 564 of second strap 560F is fixedly engaged with the forefoot support sidewall 302 of forefoot support 300 in any desired manner, including any of the various manners described above for engaging second strap 260F with forefoot support sidewall 302 of FIGS. 1A-1I (e.g., by adhesives or cements, by mechanical connectors, by a sewn seam, by a molded connection, etc.). In this example article of footwear 500 structure, the forefoot support sidewall 302 is located outside of the exterior surface 210E of upper 210 and the fixed end 564 of second strap 560F is fixed between (a) the forefoot support 300 and (b) the upper 210 and/or sole structure 220. Strap 560H, strap portions 560H1 and 560H2, and strap 560F in this example structure are non-stretchable.

Figure 4A:
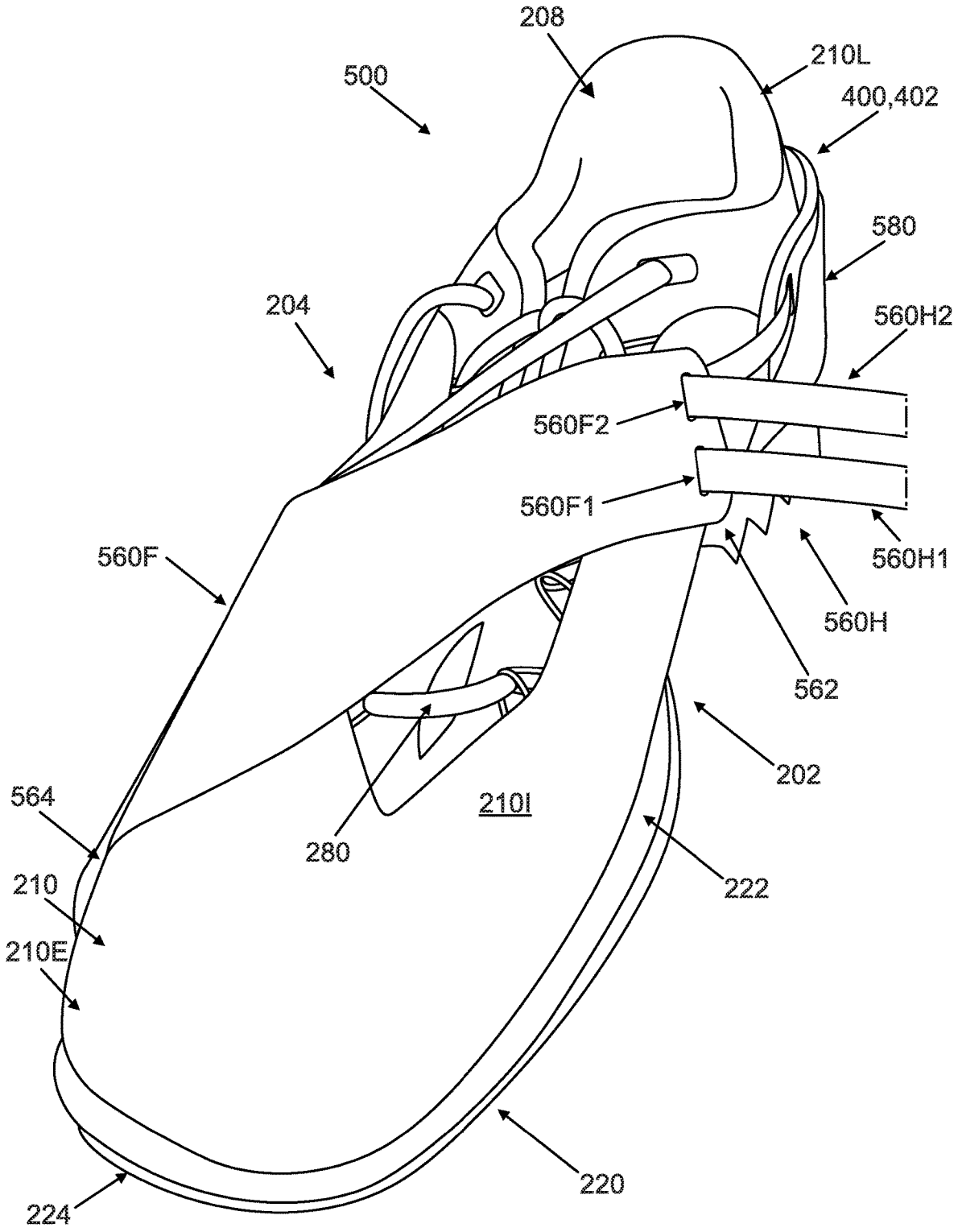
FIGS. 4A through 4G provide various views of an article of footwear and/or components thereof in accordance with another example of this invention.
Figure 4B:
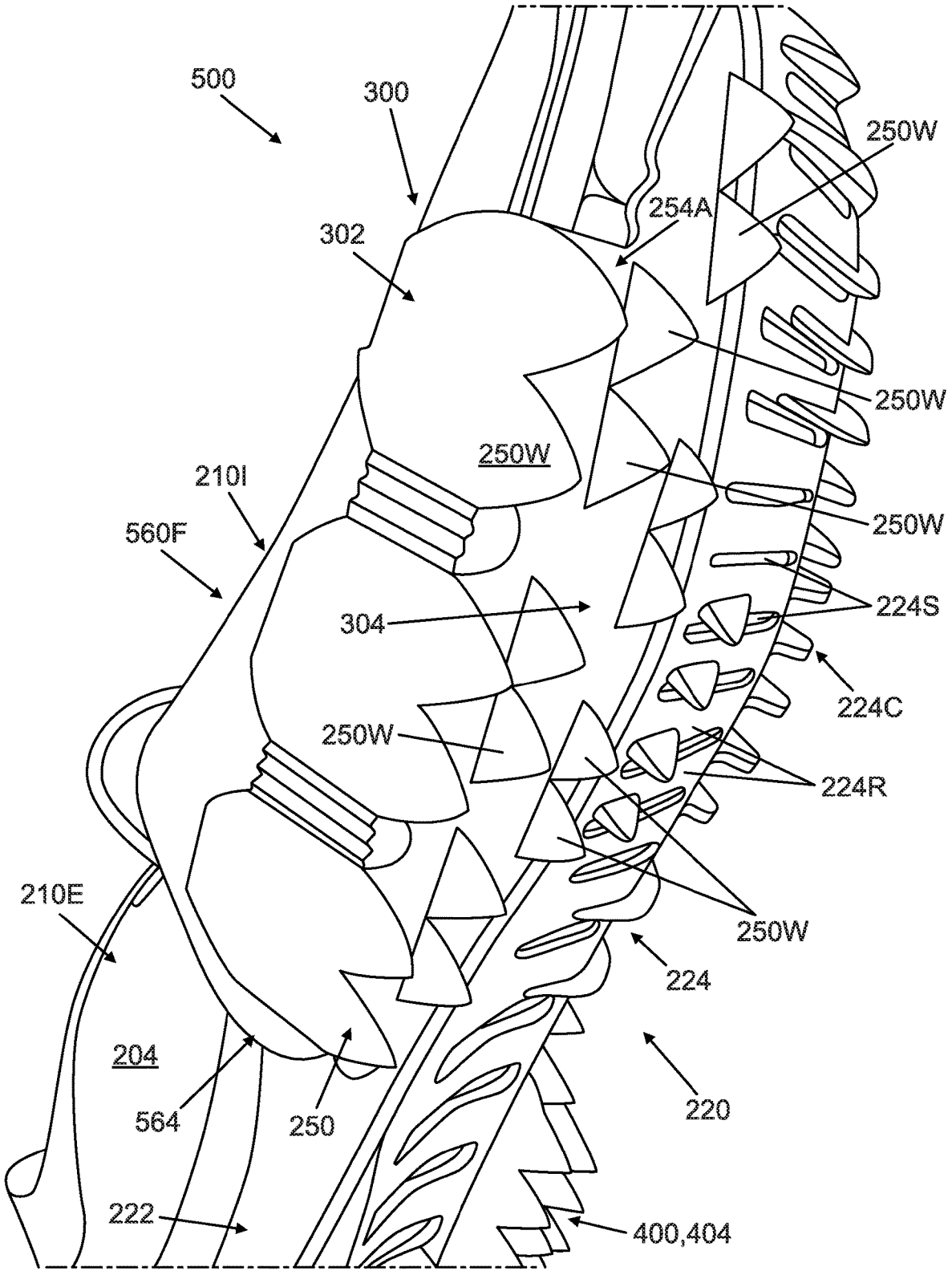
Figure 4C:
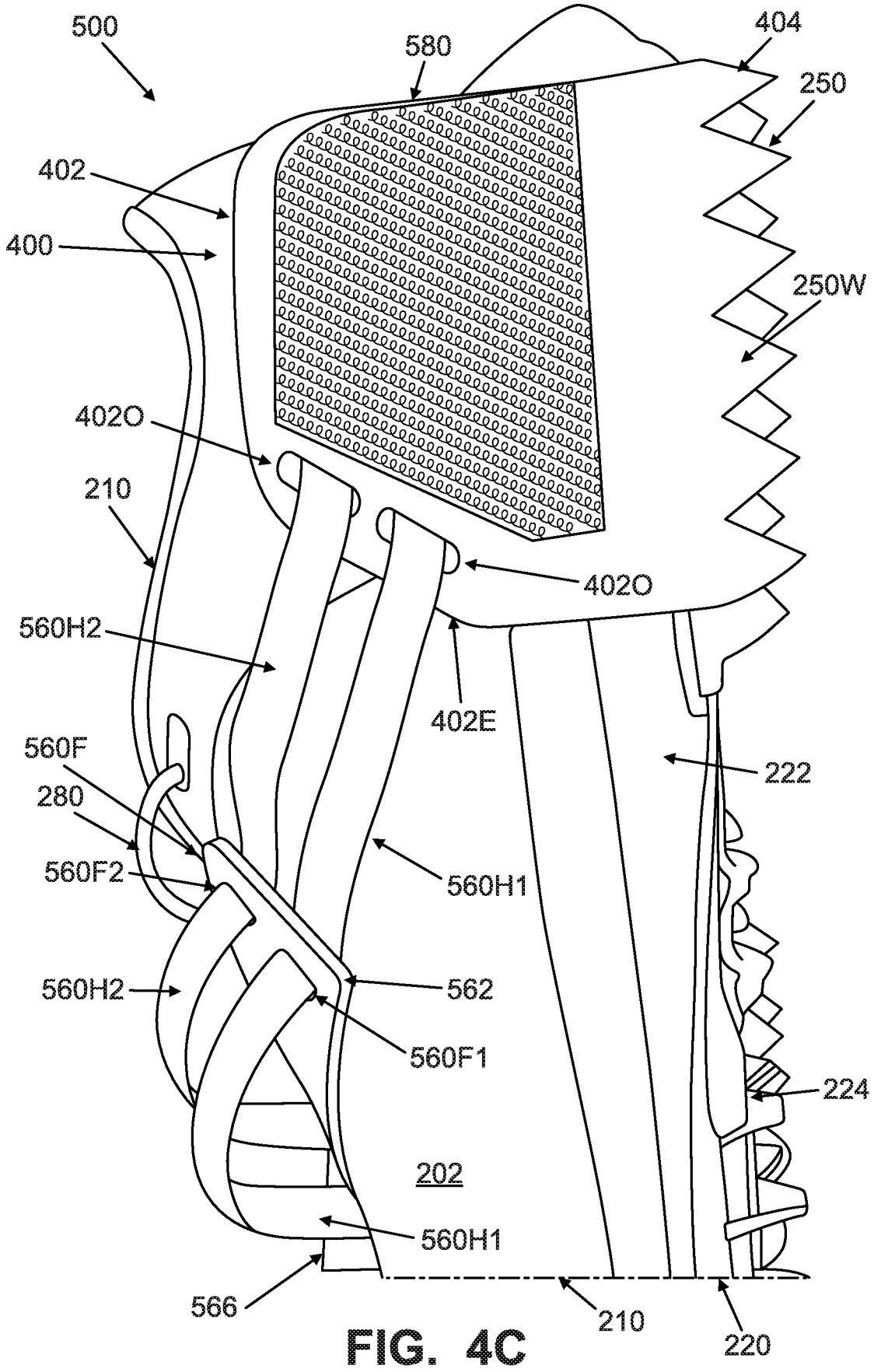
Figure 4D:
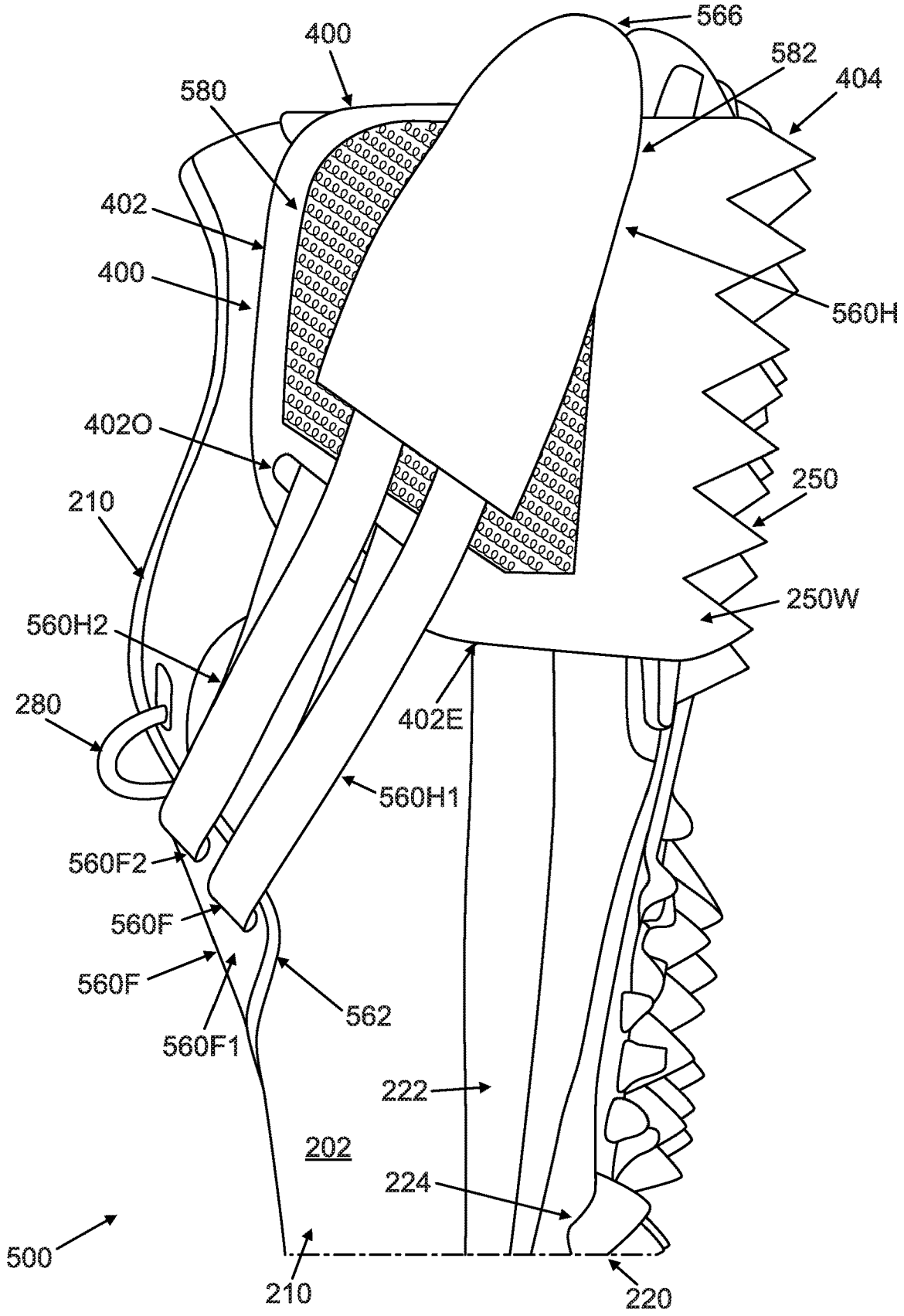
Figure 4E:
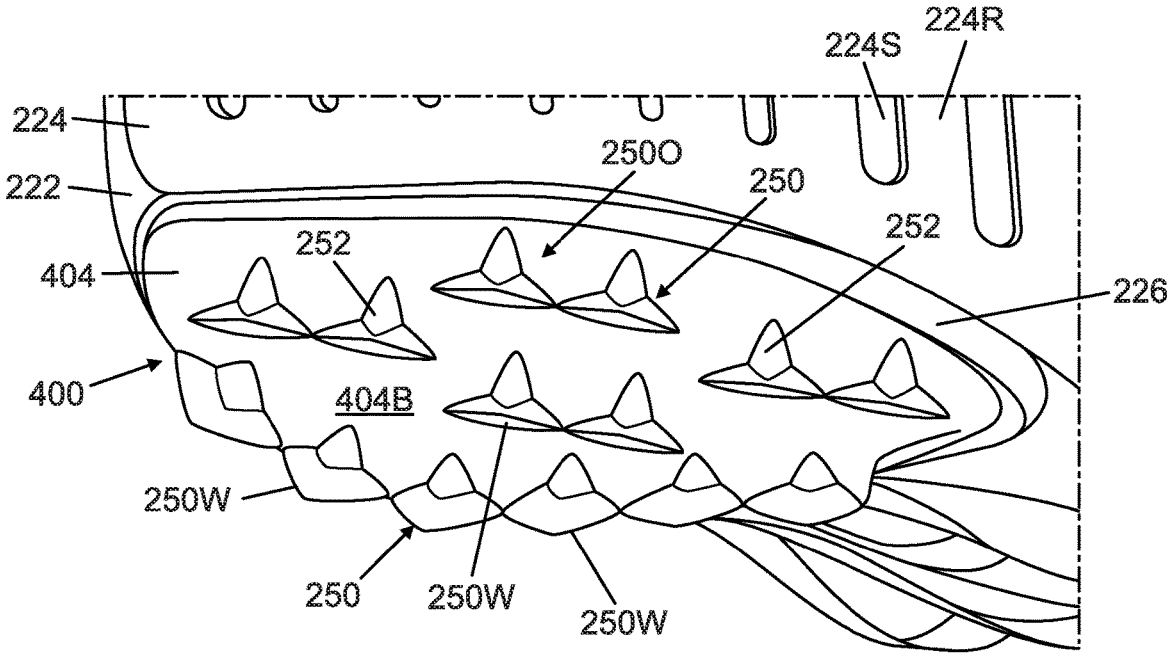
Figure 4F:
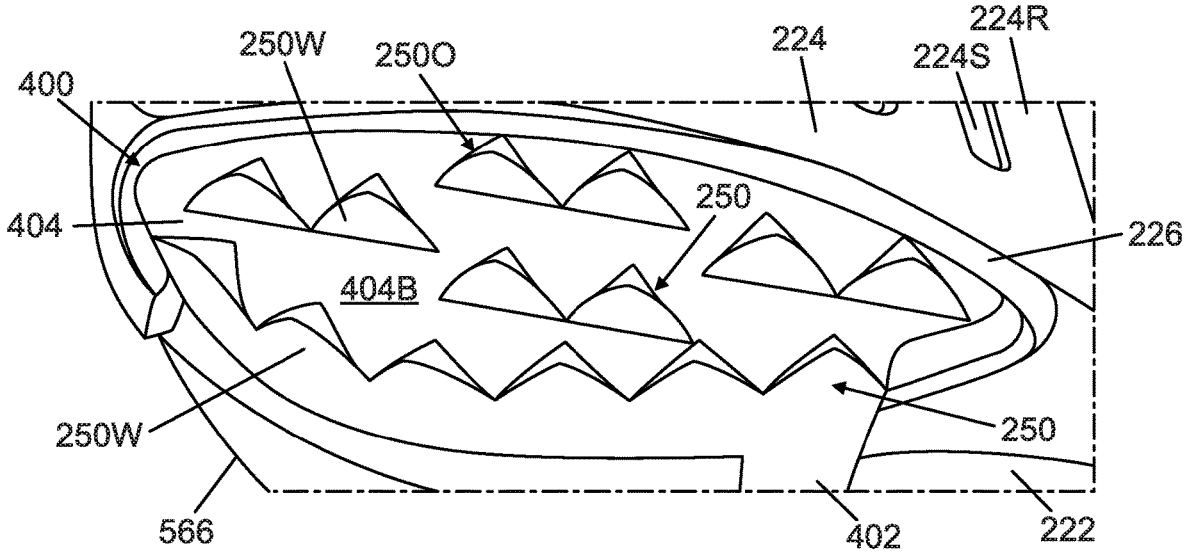
Figure 4G:
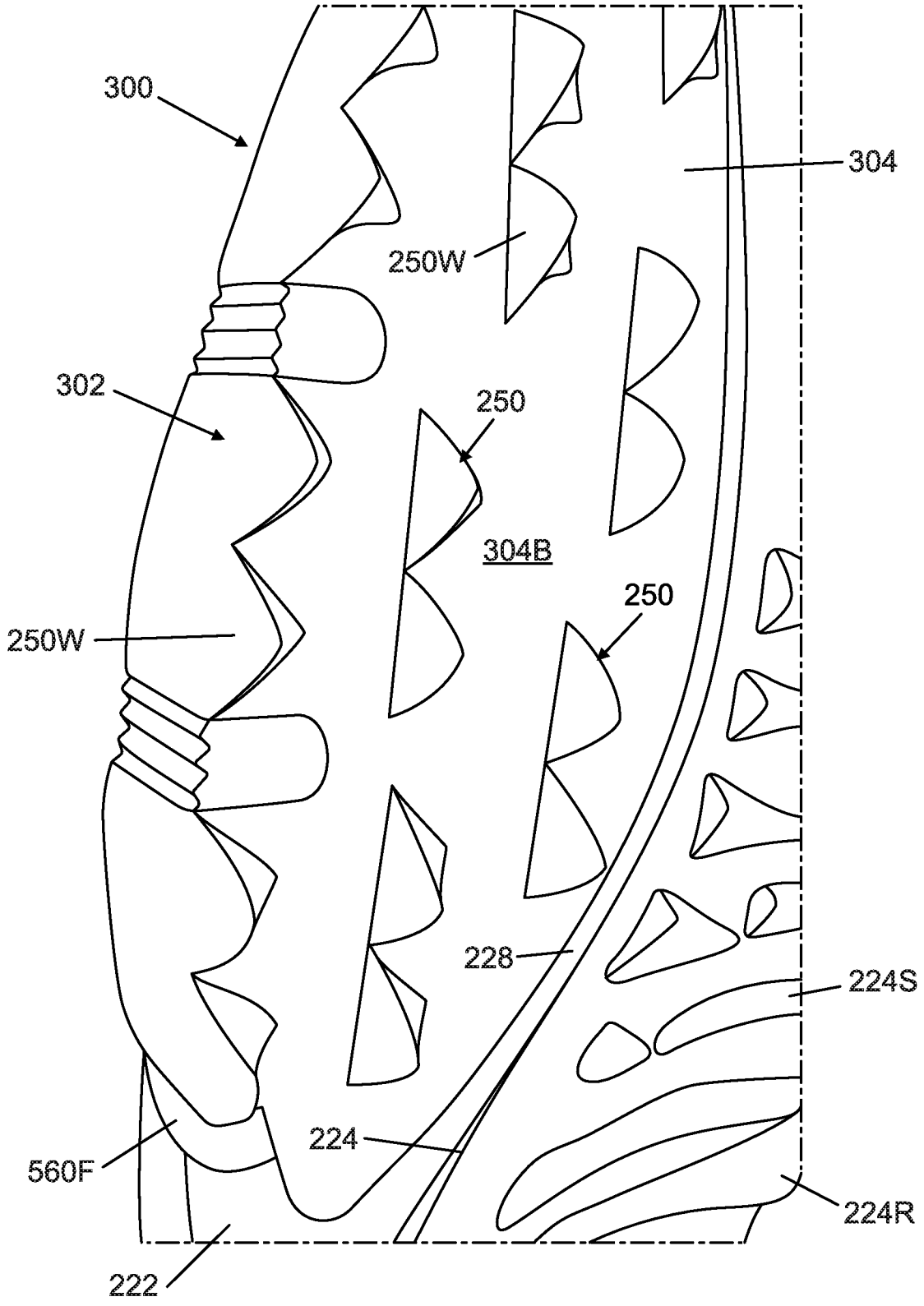

FIG. 4C shows the strap system (including straps 560H and 560F) in an open configuration, and FIG. 4D shows the strap system in a secured or closed configuration. A securing system is provided to hold at least one of the straps 560H/560F in the secured or tightened position. Any desired type of securing system for the strap(s) 560H/560F may be used without departing from this invention, such as buckles, buttons, snaps, or other fasteners. In this specifically illustrated example, the outer surface of heel support sidewall 302 includes one component 580 of a securing system (e.g., one part of a hook-and-loop type fastener) and the inside surface of first strap 560H base 566 includes another component 582 of the securing system (e.g., another part of the hook-and-loop fastener).

Use of the article of footwear 500 now will be described in more detail in conjunction with FIGS. 4C and 4D. Starting with the securing system and/or article of footwear 500 in the open condition shown in FIG. 4C, the user can insert his/her foot into the interior chamber 208I of the article of footwear 500. Once the foot is inserted, the strap system can be tightened by pulling the first strap 560H base 566 tight so that strap portions 560H1 and 560H2 pull tightly against openings 560F1 and 560F2, respectively, of the second strap 560F. With the straps 560H and 560F in a tightened condition, the securing component 582 of first strap 560H base 566 is engaged (releasably fixed) to securing component 580 on the heel support sidewall 402 to place the strap system into the secured or tightened configuration shown in FIG. 4D. In this secured or tightened configuration, strap 560F extends angular across the instep area 210I of the upper 210 in a forward lateral-to-rear medial direction (see FIG. 4A) and strap 560H (including strap portions 560H1 and 560H2) pulls this strap 560F tight. In this arrangement, the strap portions 560H1 and 560H2 pull forefoot support sidewall 302 and heel support sidewall 402 toward one another.

To loosen the strap system, the securing component 582 of first strap 560H base 566 is disengaged from securing component 580 on the heel support sidewall 402 (e.g., to put the strap system back into the open configuration shown in FIG. 4C).

Other strap arrangements and configurations are possible without departing from this invention. For example, if desired, the first strap 560H could be omitted, and second strap 560F could include one or more portions (e.g., similar to strap portions 560H1 and 560H2, and optionally strap base 566) that engage the openings 402O of the heel support sidewall 402. After passing through the openings 402O, the second strap 560F could fold back on itself and be secured, e.g., using a hook-and-loop fastener and/or any of the other securing systems described above. Alternatively, the free end of strap 560F could simply releasably attach to connector 580 on the heel support sidewall 402 or other structure in the medial heel area. As another potential option or alternative, the second strap 560F could be omitted and the forefoot support 300 could include openings similar to openings 402O of the heel support 400. In that arrangement, strap portions 560H1 and/or 560H2 could engage the openings of the forefoot support sidewall 302, and then the first strap 560H could fold back on itself and be secured, e.g., using a hook-and-loop fastener and/or any of the other securing systems described above. As still other potential options: (a) the free end (e.g., 566) of the first strap 560H could simply releasably attach to a connector at the forefoot support sidewall 302 or other structure in the lateral forefoot area or (b) a single non-stretchable and/or non-adjustable strap could extend from the first side heel area to the second side forefoot area. Other strap systems including one or more straps and/or other strap securing systems also could be used without departing from this invention.

Various aspects and features of footwear structures in accordance with aspects of this invention may function, independently or together, to provide useful properties and characteristics for various athletic activities, such as the golf swing or other activities in which torsional forces are applied to a foot/shoe. For example, the cleated outsole (including the various outsole components and cleat structures described above) may help "lock" the wearer to the ground even under the torsional forces induced in the leg/foot by a golf swing (or other activities). The substantially flat and/or substantially vertical wall surface(s) 250W of the cleats 250 and their penetrating nature (e.g., their pointed, fin, and/or triangular shape), assist in these "lock down" functions. The rigid metal or polymer material of the sidewalls 302/402, along with the substantially flat and/or substantially vertical wall surface(s) 250W of the cleats 250, help provide stable support at the medial heel and lateral forefoot areas. The relatively large (e.g., wide) straps 260H, 260F, 560H, 560F and the manners in which they can tighten down around and onto the upper 210 and their generally "unstretchable" properties can help support and prevent undesired distortion of the footwear upper 210 material, e.g., when torsional forces are applied. Also, applying the securing and/or tightening force in the diagonal direction (e.g., the lateral forefoot-to-medial heel direction), for example, by directly connecting and tightening the straps 560H and 560F or by indirectly connecting and tightening the straps 260H and 260F via lace 280 and/or by otherwise pulling the sidewalls 302/402 toward one another, provides a very stable and secure feel and good fit. These various features, individually or in any combination, provide a desirable fit and feel, e.g., for golfers or other users.

III. CONCLUSION

The present invention is disclosed above and in the accompanying drawings with reference to a variety of embodiments and/or options. The purpose served by the disclosure, however, is to provide examples of various features and concepts related to the invention, not to limit the scope of the invention. One skilled in the relevant art will recognize that numerous variations and modifications may be made to the features of the invention described above without departing from the scope of the present invention, as defined by the appended claims.

What is claimed is:

1. An article of footwear including a first side and a second side opposite the first side, the article of footwear comprising:

an upper including an instep portion;

a sole structure engaged with the upper;

a heel support engaged with at least one of the upper or the sole structure, wherein the heel support is located on the first side of the article of footwear and includes:

(a) a bottom heel support portion forming a first side heel plantar support surface at the first side of the article of footwear, the bottom heel support portion further providing a ground-engaging surface of the article of footwear, (b) a sidewall portion extending upward from the bottom heel support portion, wherein the sidewall portion of the heel support extends along a layer of the upper in a heel region of the upper and includes a forward edge located in a heel area or a midfoot area of the article of footwear; and (c) a plurality of cleats extending in a direction away from a bottom surface of the heel support, wherein the plurality of cleats are located in a heel area of the sole structure and closer to the first side of the article of footwear than to the second side, wherein two or more of the plurality of cleats each includes:

a substantially flat and substantially vertical wall facing the first side of the article of footwear, a peak, and a reinforcing support extending: (i) from a first cleat surface opposite the substantially flat and substantially vertical wall and toward the second side of the article of footwear, and (ii) from the bottom surface of the heel support toward the peak, wherein the two or more of the plurality of cleats are arranged in adjoined pairs, such that the substantially flat and substantially vertical wall is a continuous wall that joins the two or more of the plurality of cleats;

a forefoot support engaged with at least one of the upper or the sole structure, wherein the forefoot support is located on the second side of the article of footwear opposite from the first side of the article of footwear and includes:

(a) a bottom forefoot support portion forming a second side forefoot plantar support surface at the second side of the article of footwear, and (b) a sidewall portion extending upward from the bottom forefoot support portion, wherein the sidewall portion of the forefoot support includes a rearward edge located in a forefoot area or the midfoot area of the article of footwear; and a strap system connecting the heel support and the forefoot support across the instep portion.

2. The article of footwear according to claim 1, wherein the sole structure includes an outsole component that extends from a rear heel area of the article of footwear to a forward toe area of the article of footwear and across the midfoot area of the article of footwear from the second side of the article of footwear in the heel area to the first side of the article of footwear in the forefoot area.

3. The article of footwear according to claim 1, wherein a bottom surface of the bottom forefoot support portion of the forefoot support includes one or more cleats extending in a direction away from the bottom surface of the bottom forefoot support portion, and wherein at least one cleat of the one or more cleats extending from the bottom forefoot support portion includes a substantially flat and substantially vertical wall facing the second side of the article of footwear.

4. The article of footwear according to claim 1, wherein the strap system includes a first strap engaged with the heel support and a second strap engaged with the forefoot support.

5. The article of footwear according to claim 4, wherein the first strap includes a first plurality of lace-engaging openings defined therein, wherein the second strap includes a second plurality of lace-engaging openings defined therein, and wherein the strap system further includes a lace that extends between and engages the first plurality of lace-engaging openings and the second plurality of lace-engaging openings.

6. The article of footwear according to claim 4, wherein the first strap is directly engaged with the second strap.

7. The article of footwear according to claim 6, further including a securing system for releasably holding at least one of the first strap and the second strap in a tightened condition.

8. The article of footwear according to claim 4, wherein the first strap is engaged with the sidewall portion of the heel support, and wherein the second strap is engaged with the sidewall portion of the forefoot support.

9. An article of footwear including a first side and a second side opposite the first side, the article of footwear comprising:

an upper;

a sole structure engaged with the upper, wherein the sole structure includes:

(a) a first plurality of cleats located in a heel area of the sole structure and closer to the first side of the article of footwear than to the second side, wherein two or more of the first plurality of cleats include a substantially flat and substantially vertical wall facing the first side of the article of footwear and at least a first peak and a second peak, and a first reinforcing support extending from a first cleat surface opposite the substantially flat and substantially vertical wall and toward the second side of the article of footwear and to the first peak, and wherein the first plurality of cleats are arranged in adjoined pairs such that the substantially flat and substantially vertical wall is a continuous wall that joins the two or more of the first plurality of cleats; and (b) a second plurality of cleats located in a forefoot area of the sole structure and closer to the second side of the article of footwear than to the first side, wherein two or more of the second plurality of cleats include a substantially flat and substantially vertical wall facing the second side of the article of footwear;

a heel support sidewall extending along a layer of the upper in a heel region of the upper and engaged with at least one of the upper or the sole structure, wherein the heel support sidewall extends only along the first side of the article of footwear, wherein the heel support sidewall includes a forwardmost edge located in a heel area or a midfoot area of the article of footwear, wherein the first plurality of cleats are provided on a first outsole component, and wherein the first outsole component is integrally formed with the heel support sidewall as a unitary, one-piece construction; and a forefoot support sidewall engaged with at least one of the upper or the sole structure, wherein the forefoot support sidewall extends only along the second side of the article of footwear, wherein the forefoot support sidewall includes a rearwardmost edge located in a forefoot area or the midfoot area of the article of footwear, and wherein each of the heel support sidewall and the forefoot support sidewall is formed from at least one member selected from the group consisting of a metal material and a molded polymer material.

10. The article of footwear according to claim 9, wherein the second plurality of cleats are provided on a second outsole component that is a separate part from the first outsole component, wherein the sole structure further includes a third outsole component that extends from a rear heel area of the article of footwear to a forward toe area of the article of footwear and across the midfoot area of the article of footwear from the second side of the article of footwear in the heel area to the first side of the article of footwear in the forefoot area, and wherein the third outsole component is a separate part from the first outsole component and the second outsole component.

11. The article of footwear according to claim 9, wherein said two or more of the second plurality of cleats further include a second reinforcing support extending from a second cleat surface opposite the substantially flat and substantially vertical wall and toward the first side of the article of footwear.

12. The article of footwear according to claim 10, wherein the second outsole component is integrally formed with the forefoot support sidewall as a unitary, one-piece construction.

13. The article of footwear according to claim 9, further comprising:

a strap system connecting the heel support sidewall and the forefoot support sidewall across an instep portion of the upper, wherein the strap system includes a first strap engaged with the heel support sidewall and a second strap engaged with the forefoot support sidewall.

14. The article of footwear according to claim 13, wherein the strap system further includes a lace that extends between and engages each of the first strap and the second strap.

15. The article of footwear according to claim 13, wherein the first strap is directly engaged with the second strap.

16. An article of footwear including a first side and a second side opposite the first side, the article of footwear comprising:

an upper;

a sole structure engaged with the upper;

a heel support engaged with at least one of the upper or the sole structure, the heel support including:

(a) a bottom heel support portion forming a ground-engaging surface of the article of footwear, and (b) a heel support sidewall extending upward from the bottom heel support portion, wherein the heel support sidewall extends along a first layer of the upper in a heel region of the upper and only along the first side of the article of footwear, and wherein the heel support sidewall includes a forwardmost edge located in a heel area or a midfoot area of the article of footwear;

a forefoot support sidewall engaged with at least one of the upper or the sole structure, wherein the forefoot support sidewall extends only along the second side of the article of footwear, wherein the forefoot support sidewall includes a rearwardmost edge located in a forefoot area or the midfoot area of the article of footwear, and wherein each of the heel support sidewall and the forefoot support sidewall is formed from at least one member selected from the group consisting of a metal material and a molded polymer material;

a strap system connecting the heel support sidewall and the forefoot support sidewall across an instep portion of the upper; and wherein at least a portion of the heel support sidewall is located between the first layer of the upper and a second layer of the upper.

17. The article of footwear according to claim 16, wherein the strap system includes a first strap engaged with the heel support sidewall and a second strap engaged with the forefoot support sidewall.

18. The article of footwear according to claim 16, wherein the first side is a medial side of the article of footwear and the second side is a lateral side of the article of footwear.

* * * * *